US006592500B1

(12) United States Patent
McBride et al.

(10) Patent No.: US 6,592,500 B1
(45) Date of Patent: Jul. 15, 2003

(54) EXERCISE DEVICE

(75) Inventors: Robert W. McBride, Springfield, MO (US); Paul Chen, Vancouver (CA)

(73) Assignee: Stamina Products, Inc., Springfield, MO (US)

( * ) Notice: Subject to any disclaimer, the term of this patent is extended or adjusted under 35 U.S.C. 154(b) by 162 days.

(21) Appl. No.: 09/776,661

(22) Filed: Feb. 6, 2001

Related U.S. Application Data

(63) Continuation-in-part of application No. 09/342,039, filed on Jun. 28, 1999, now abandoned.

(51) Int. Cl.[7] ..... A63B 26/00; A63B 71/00
(52) U.S. Cl. ..... 482/140; 482/907
(58) Field of Search ..... 482/907, 140, 482/148, 91, 908

(56) References Cited

U.S. PATENT DOCUMENTS

| | | | | |
|---|---|---|---|---|
| 5,346,447 | A | | 9/1994 | Stearns |
| 5,492,520 | A | | 2/1996 | Brown |
| 5,577,987 | A | | 11/1996 | Brown |
| D379,836 | S | | 6/1997 | Chen |
| D380,517 | S | * | 7/1997 | Ho ..... D21/191 |
| D381,378 | S | | 7/1997 | Colonello et al. |
| D385,930 | S | | 11/1997 | Chen |
| 5,692,997 | A | | 12/1997 | Stearns |
| 5,702,334 | A | | 12/1997 | Lee |
| D395,684 | S | | 6/1998 | Olschansky et al. |
| 5,772,562 | A | | 6/1998 | Stevens |
| 5,776,039 | A | | 7/1998 | Perez, Jr. |
| 5,776,042 | A | | 7/1998 | Szabo |
| 5,813,957 | A | | 9/1998 | Rossiter |
| D404,432 | S | | 1/1999 | Sands |
| 5,941,806 | A | | 8/1999 | Olschansky et al. |
| 6,090,023 | A | * | 7/2000 | Liu ..... 482/140 |
| 6,117,057 | A | | 9/2000 | Olschansky et al. |

OTHER PUBLICATIONS

Precise Exercise Equipment, Inc., The Perfect Abdominal Workout, AB Trainer, 1994.

Skorupa, Crunch Time, Popular Mechanics, pp. 60–63, Jul., 1997.

* cited by examiner

*Primary Examiner*—Nicholas D. Lucchesi
*Assistant Examiner*—Lori Baker Amerson
(74) *Attorney, Agent, or Firm*—Pillsbury Winthrop LLP

(57) ABSTRACT

An exercise device is constructed and arranged to be used by a user to perform multiple exercises, which exercises utilize the user's weight as resistance. The exercise device comprises a pair of manually movable structures including U-shaped rocker elements having downwardly facing convex surfaces constructed and arranged to be supported on a horizontal surface. The pair of movable structures include a pair of hand grips which are to be moved by the user when supported by a user support structure connected between the pair of movable structures. Movement of the hand grips moves the user support structure disposed adjacent the horizontal surface upwardly from the horizontal surface enabling the user to resist such movement and manually resist a return movement by the supported weight of the user on the user support structure.

34 Claims, 19 Drawing Sheets

EXERCISE DEVICE

CROSS-REFERENCE TO RELATED APPLICATIONS

This application is a continuation-in-part of U.S. application Ser. No. 09/342,039 filed Jun. 28, 1999, abandoned the content of which is hereby incorporated by reference into the present specification.

FIELD OF THE INVENTION

The present invention relates to an exercise device such as disclosed in the '039 application. More specifically, the present invention relates to an exercise device that permits multiple exercises to be performed and utilizes the user's weight as resistance.

BACKGROUND OF THE INVENTION

The present invention relates to the exercise device disclosed in the '039 application cited above. The background section of the '039 application discussed patents (U.S. Pat. Nos. 5,492,520 and 5,577,987) relating to a completely different kind of exerciser that has some superficial structural similarities with respect to the exerciser disclosed therein. More specifically, rather than providing multiple exercises resisted by the user's weight, the '520 and '987 patents aid the user in performing sit-ups.

The '520 and '987 patents disclose an abdominal exercise device having a frame structure bent to provide laterally spaced support rails that are connected together at one end to provide a pair of hand grips and terminate at opposite ends in a pair of arm rests. A head support is pivotally suspended from the support rails between the end connection and intermediate rocker portions of the rails. The head support is positioned with respect to the hand grips and the arm supports in order to support the user's head as the user performs a sit-up. The device enables a user supinely positioned between the intermediate rocker portions of the rails with the user's neck and head supported on the head support to exercise the abdominal muscles of the user by rocking the frame back and forth. These devices aid the user in performing sit-ups so as to isolate the abdominal muscles and not stress the user's back or neck.

The present invention is not useful in enabling a user to perform a sit-up. The present invention includes U-shaped rocker elements and a user support but the user support is not a head support and cannot be used to support the user's head as the user performs a sit-up. Instead, it is used to support a substantial portion of the user's weight and to move vertically with the user's weight thereon so as to provide the resistance used in multiple exercises.

Consequently, exercisers of the type disclosed in the '520 and '987 patents have only a superficial structural similarity with the present invention. The device of the present invention functions differently than the '520 and '987 patents' devices, the way is different, and the results are different, as will become clearly apparent in the disclosure that follows.

SUMMARY OF THE INVENTION

The present invention contemplates exercise devices such as disclosed in the '039 application which function and achieve results in a manner as indicated above. In accordance with the above, the present invention provides an exercise device comprising a pair of laterally spaced manually movable structures including U-shaped rocker elements having downwardly facing convex surfaces constructed and arranged to be supported on a horizontal surface. A user support structure is connected between the pair of movable structures. The user support structure is constructed and arranged when in an operative starting position to support a user in a supine position wherein the user is disposed in supine relation on the horizontal surface with the knees bent upwardly and the lower back supported on the user support structure disposed adjacent the horizontal surface. The user support structure is also constructed and arranged when in the operative starting position to support a user in a seated position wherein the user is disposed in seated relation on the user support structure disposed adjacent the horizontal surface with legs extended and bent at the knees and the feet resting on the horizontal surface. The pair of laterally spaced manually movable structures include a pair of operatively fixed hand grips disposed in an operative starting position above the horizontal surface at a level to be grasped by a user in the supine position with the arms disposed upwardly and bent at the elbows and a user in the seated position with the arms extending outwardly. The convex surfaces of the rocker elements of the pair of manually movable structures are configured and positioned so that a rearward operative movement of the hand grips away from the operative starting position in a rearward direction will move the user support structure upwardly from the operative starting position thereof. A user in the supine position effects the rearward operative movement of the hand grips in the rearward direction by extending the user's arms. Such movement is resisted by the user's supported weight on the user support structure. A return movement is manually resisted by the supported weight of the user on the user support structure. A user in the seated position effects the rearward operative movement of the hand grips in the rearward direction by a pull with palms down and elbows out or a curl with palms up and elbows down. Such movement is resisted by the user's supported weight on the user support structure. A return movement is manually resisted by the supported weight of the user on the user support structure.

The present invention further provides an exercise device comprising a pair of laterally spaced manually movable structures including U-shaped rocker elements having downwardly facing convex surfaces constructed and arranged to be supported on a horizontal surface. A user support structure is connected between the pair of movable structures. The user support structure is constructed and arranged when in an operative starting position to support a user in a seated position. In the seated position, the user is disposed in seated relation on the user support structure disposed adjacent the horizontal surface with legs extended and bent at the knees and the feet resting on the horizontal surface. The pair of laterally spaced manually movable structures include a pair of operatively fixed hand grips disposed in an operative starting position above the horizontal surface at a level to be grasped by a user in the seated position with the arms disposed outwardly and bent at the elbows. The convex surfaces of the rocker elements of the pair of manually movable structures are configured and positioned so that a forward operative movement of the hand grips away from the operative starting position in a forward direction will move the user support structure upwardly from the operative starting position thereof. A user in the seated starting position effects the forward operative movement by extending the user's arms and resists such movement by the user's supported weight on the user support structure. A return movement is manually resisted by the supported weight of the user on the user support structure.

The present invention still further provides an exercise device comprising a pair of laterally spaced manually movable structures including U-shaped rocker elements having downwardly facing convex surfaces constructed and arranged to be supported on a horizontal surface. A user support structure is connected between the pair of movable structures. The user support structure is constructed and arranged when in an operative starting position to support a user in a supine position wherein the user is disposed in supine relation on the horizontal surface with the knees bent upwardly and the lower back supported on the user support structure disposed adjacent the horizontal surface. The pair of laterally spaced manually movable structures include a pair of operatively fixed hand grips disposed in an operative starting position above the horizontal surface at a level to be grasped by a user in the supine position with the arms extended upwardly and outwardly. The convex surfaces of the rocker elements of the pair of manually movable structures are configured and positioned so that a rearward operative movement of the hand grips away from the operative starting position in a rearward direction will move the user support structure upwardly from the operative starting position thereof. A user in the supine position effects the rearward operative movement of the hand grips in the rearward direction by pulling down on the hand grips and resists such movement by the user's supported weight on the user support structure. A return movement is manually resisted by the supported weight of the user on the user support structure.

The present invention still further provides an exercise device comprising a pair of laterally spaced manually movable structures including U-shaped rocker elements having downwardly facing convex surfaces constructed and arranged to be supported on a horizontal surface. A user support structure is connected between the pair of movable structures. The user support structure is constructed and arranged when in an operative starting position to support a user in a seated position wherein the user is disposed in seated relation on the user support structure disposed adjacent the horizontal surface with legs extended and bent at the knees and the feet resting on the horizontal surface. The user support structure is also constructed and arranged when in an operative starting position to support a user in a reverse seated position wherein the user is disposed in the same manner as in the seated position but in a reverse position on the user support structure. The pair of laterally spaced manually movable structures include a pair of operatively fixed hand grips disposed in an operative starting position above the horizontal surface. The hand grips when in the operative starting position include free ends facing toward one another in spaced relation and a bridging member is selectively telescopically mounted over the hand grips so as to extend in the space therebetween. The bridging member has a cushioned central portion. The configuration and position of the cushioned central portion with respect to the hand grips enables a user in the seated position to grasp the cushioned central portion with the arms disposed outwardly and bent at the elbows. The configuration and position of the cushioned central portion with respect to the hand grips also enables a user in the seated position but with the arms down to move the user's chest forwardly into the cushioned central portion of the centrally cushioned member. The configuration and position of the cushioned central portion with respect to the hand grips further enables a user in the reverse seated position on the user support structure to move the user's back rearwardly into the cushioned central portion. The convex surfaces of the rocker elements of the pair of manually movable structures are constructed and arranged so that a forward operative movement of the hand grips away from the operative starting position in a forward direction will move the user support structure upwardly from the operative starting position thereof. A user in the seated position grasping the cushioned central portion effects the forward operative movement by extending the arms outwardly which moves the hand grips away from the operative starting position in the forward direction. Such movement is resisted by the user's supported weight on the user support structure. A return movement is manually resisted by the supported weight of the user on the user support structure. A user in the seated position but with arms down and the user's chest moved forwardly into the cushioned central portion of the centrally cushioned member effects the forward operative movement by the continued forward movement of the chest of the user which moves the hand grips away from the operative starting position in the forward direction. Such movement is resisted by the user's supported weight on the user support structure. A return movement is resisted by chest contact by the supported weight of the user on the user support structure. A user seated in the reverse seated position on the user support structure and the user's back moved rearwardly into the cushioned central portion effects the forward operative movement by the continued rearward movement of the user's back which moves the hand grips away from the operative starting position in the forward direction. Such movement is resisted by the user's supported weight on the user support structure. A return movement is resisted by back contact by the supported weight of the user on the user support structure.

It is a further object to provide different combinations and permutations of the above, including all.

These and other objects, features, and advantages of this invention will become apparent from the following detailed description when taken in conjunction with the accompanying drawings, which are a part of this disclosure and which illustrate, by way of example, the principles of this invention.

BRIEF DESCRIPTION OF THE DRAWINGS

The accompanying drawings facilitate an understanding of the various embodiments of this invention. In such drawings.

DETAILED DESCRIPTION OF THE INVENTION

Figure 1:
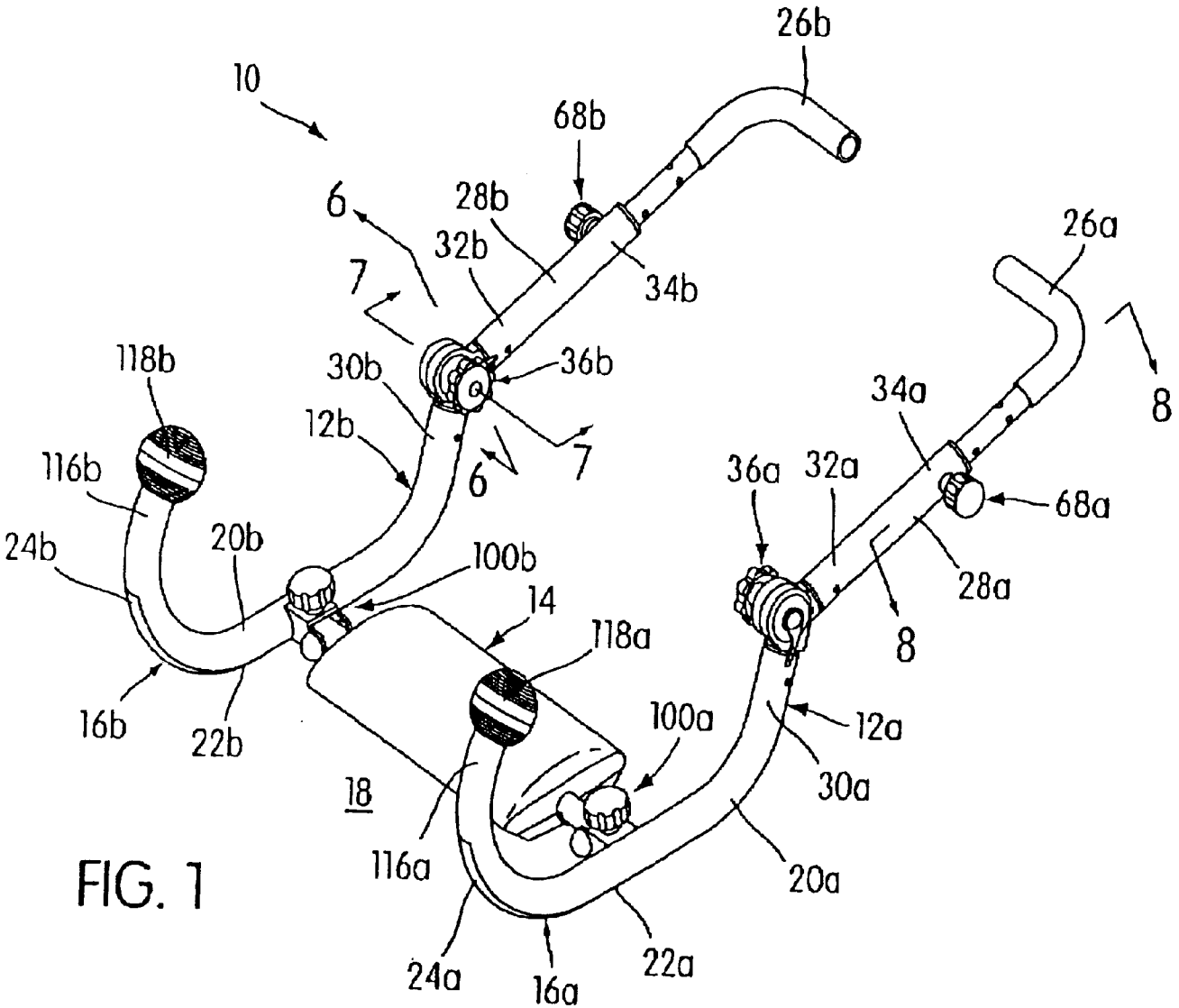
FIG. 1 is a perspective view of an exercise device constructed in accordance with the principles of the present invention.

FIG. 1 shows an exercise device 10, which exercise device 10 embodies the principles of the present invention. The main components of the exercise device 10 are a pair of laterally spaced manually movable structures 12*a*, 12*b* and a user support structure 14 that is connected between the pair of movable structures 12*a*, 12*b*. The pair of manually movable structures 12*a*, 12*b* are mirror images of one another, therefore corresponding elements will have similar reference numerals.

The pair of movable structures 12*a*, 12*b* each have lower end portions 16*a*, 16*b* constructed and arranged to be supported on a horizontal surface 18, such as the floor. Specifically, the lower end portions 16*a*, 16*b* include U-shaped rocker elements 20*a*, 20*b* having downwardly facing convex surfaces 22*a*, 22*b*, which engage the horizontal surface 18 to support the pair of movable structures 12*a*, 12*b* thereon. In the illustrated embodiment, the U-shaped rocker elements 20*a*, 20*b* are tubular. Gripping structures 24*a*, 24*b* are secured to the convex surfaces 22*a*, 22*b*, by an adhesive for example, to prevent lateral sliding movement of the movable structures 12*a*, 12*b* during an operative movement of the device 10 during an exercise. The pair of movable structures 12*a*, 12*b* further include a pair of operatively fixed hand grips 26*a*, 26*b* which are adapted to be disposed in multiple operative starting positions, as will be further discussed.

Figure 3:
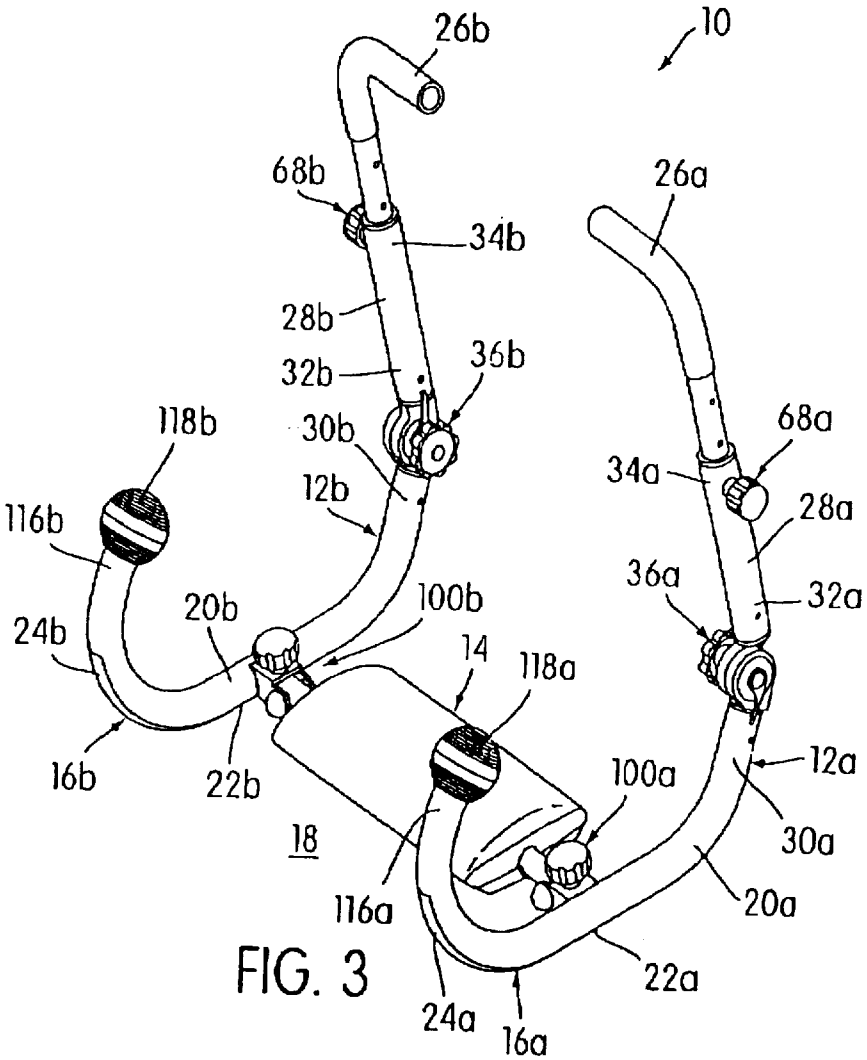
FIG. 3 is a perspective view showing the device of FIG. 1 with the hand grips in a further alternative operative starting position.
Figure 2:
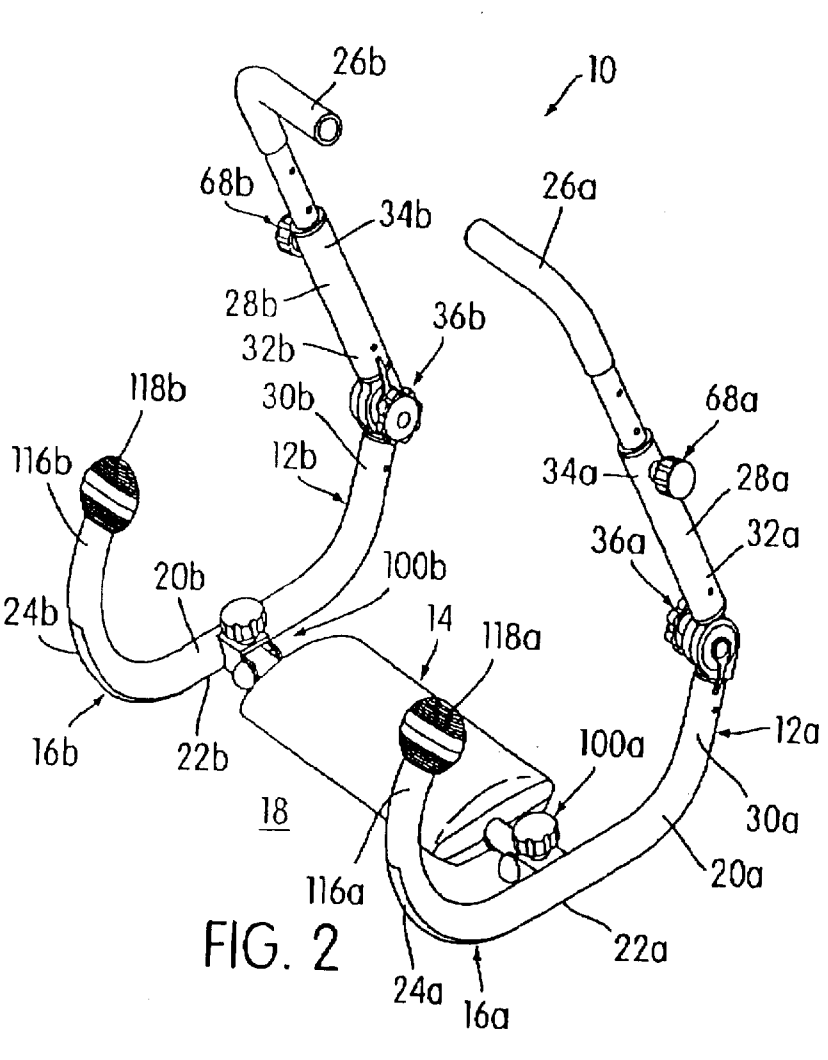
FIG. 2 is a perspective view showing the device of FIG. 1 with the hand grips in an alternative operative starting position.

Each of the U-shaped rocker elements 20*a*, 20*b* has hand grip carrying straight arm elements 28*a*, 28*b* adjustably fixed to one end 30*a*, 30*b* thereof. In the illustrated embodiment, the arm elements 28*a*, 28*b* are tubular and have a longitudinal axis. Each arm element 28*a*, 28*b* has one end 32*a*, 32*b* adjustably fixed to the one end 30*a*, 30*b* of the associated U-shaped rocker elements 20*a*, 20*b*. An opposite end 34*a*, 34*b* of each arm element 28*a*, 28*b* rotatably mounts the hand grips 26*a*, 26*b*, as will be further discussed. The arm elements 28*a*, 28*b* are adjustably fixed to associated U-shaped rocker elements 20*a*, 20*b* by a releasable adjusting assembly 36*a*, 36*b* to enable each arm element 28*a*, 28*b*, and hence the hand grips 26*a*, 26*b* mounted thereto, to be moved between multiple operative starting positions. Specifically, the releasable adjusting assembly 36*a*, 36*b* enables movement of the hand grips 26*a*, 26*b* between an operative starting position of the hand grips 26*a*, 26*b*, as shown in FIG. 1, and a pair of second operative starting positions of the hand grips 26*a*, 26*b*, as shown in FIGS. 2–3. The multiple positioning of the hand grips 26*a*, 26*b* enables a user to perform various physical exercises using the device 10. Several exercises are performed with the hand grips 26*a*, 26*b* in the operative starting position and several exercises are performed with the hand grips 26*a*, 26*b* in one of the pair of second operative starting positions, as will be further discussed.

The pair of second operative starting positions, as shown in FIGS. 2–3 are used for the same exercises. A pair of second operative starting positions is provided so that users of all body types and fitness levels may perform the exercises associated therewith comfortably. The user may choose to select only one of the pair of second operative positions of the hand grips 26*a*, 26*b* to use throughout the exercises associated therewith or the user may prefer to vary between the pair of second operative starting positions for different exercises. It should be noted that the second operative starting position of the hand grips 26*a*, 26*b* as shown in FIG. 2 allows the user to perform exercises through a fuller range of motion than the second operative starting position of the hand grips 26*a*, 26*b* as shown in FIG. 3.

Figure 4:
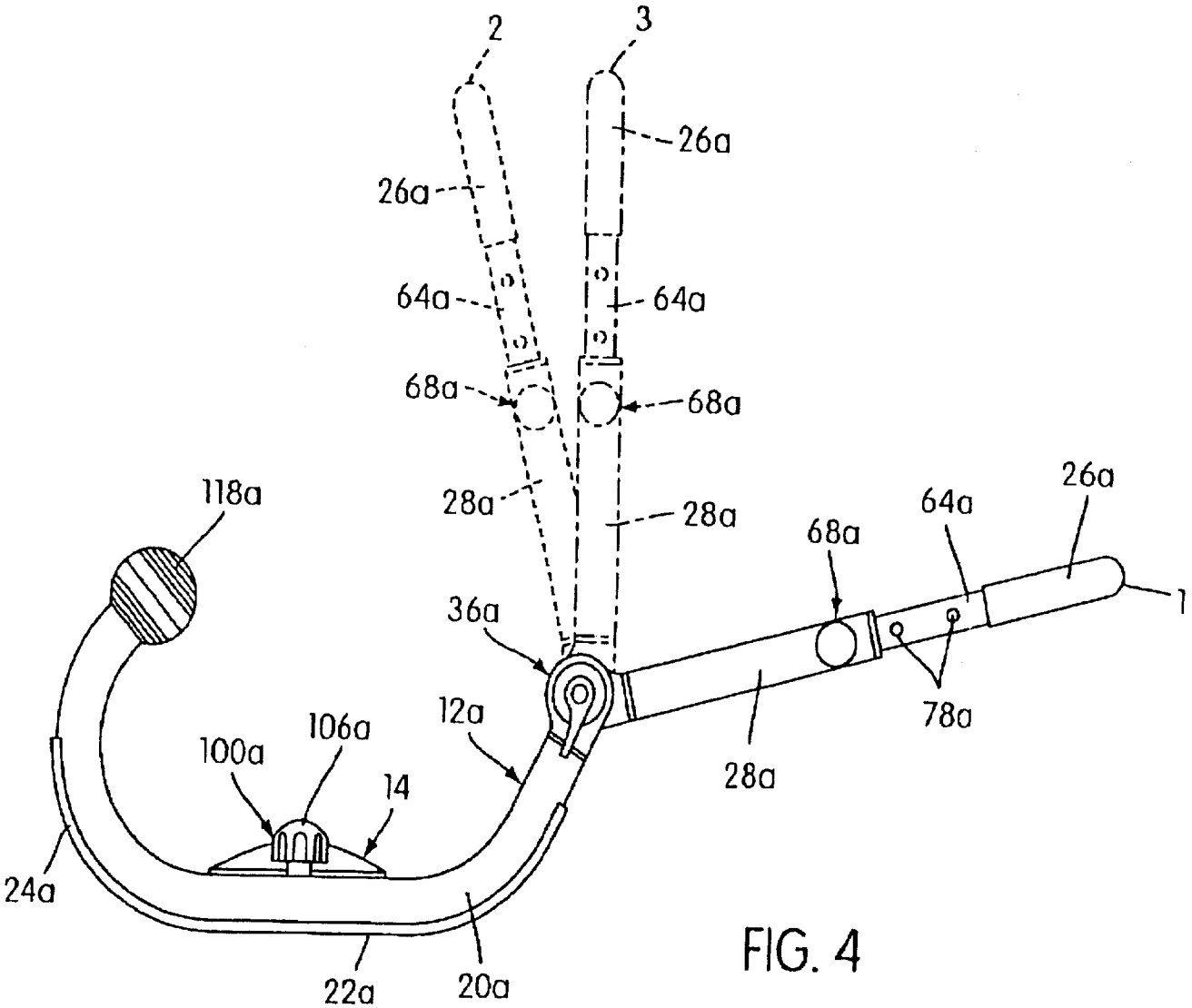
FIG. 4 is a side view of FIG. 1 with alternative operative starting positions of the hand grips, as shown in FIGS. 2–3, shown in phantom lines.

FIG. 4 shows the relationship between the operative starting position (shown in solid) and the pair of second operative starting positions (shown in phantom) of the hand grips 26*a*, 26*b*. The positioning of the hand grips 26*a*, 26*b* as shown in FIG. 1 is referenced with 1, the positioning of the hand grips 26*a*, 26*b* as shown in FIG. 2 is referenced with 2, and the positioning of the hand grips 26*a*, 26*b* as shown in FIG. 3 is referenced with 3.

Figure 5:
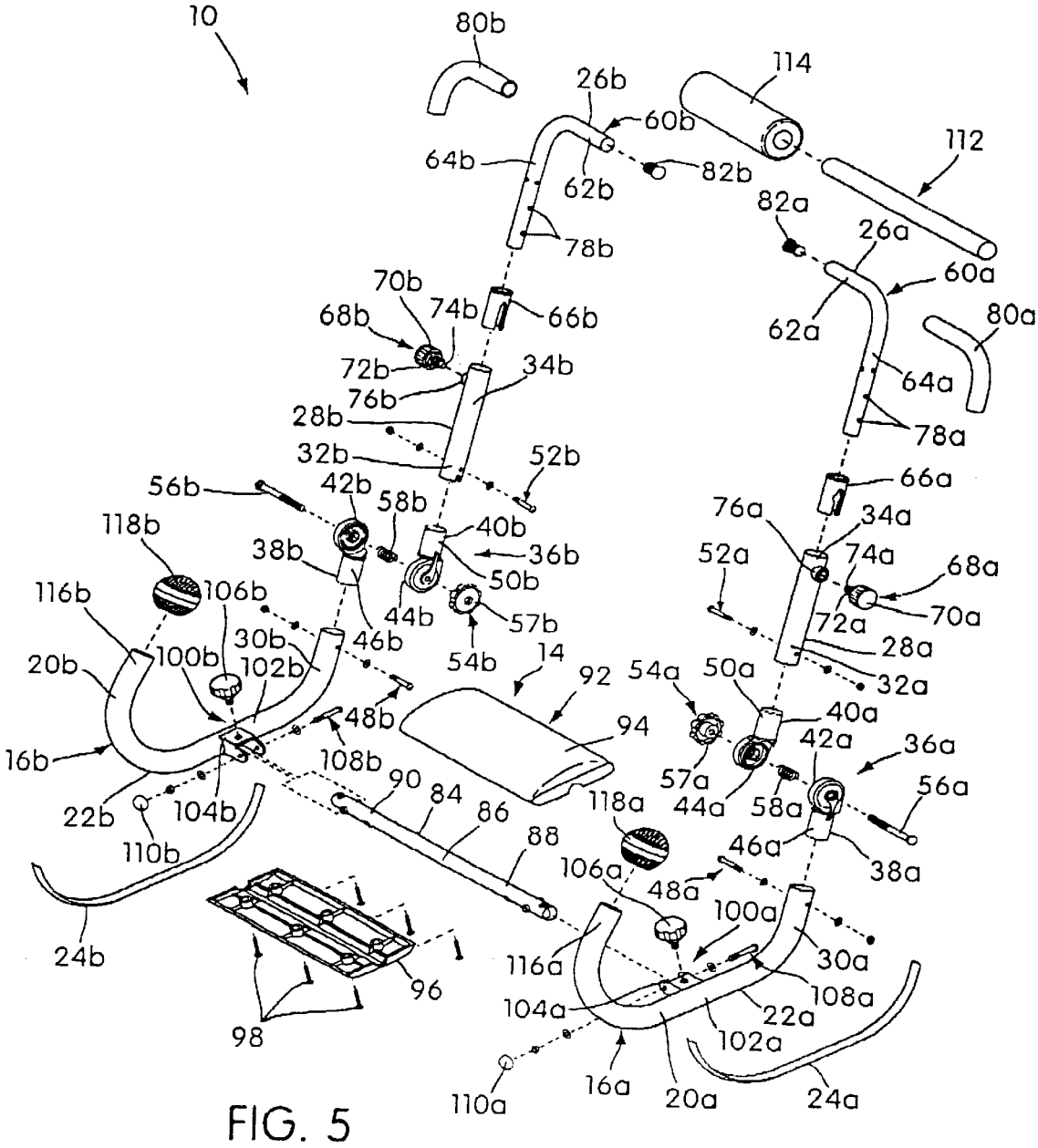
FIG. 5 is an exploded view of the exercise device of the present invention.

Referring more particularly to FIG. 5, each of the releasable adjusting assemblies 36*a*, 36*b* comprises a first cooperating interlocking toothed structure 38*a*, 38*b* and a second cooperating interlocking toothed structure 40*a*, 40*b*. The first toothed structures 38*a*, 38*b* and the second toothed structures 40*a*, 40*b* are interlockable with one another, respectively, to fix each arm element 28*a*, 28*b* selectively in the operative starting position and the pair of second operative starting positions. The first toothed structures 38*a*, 38*b* and the second toothed structures 40*a*, 40*b* are also cooperable with one another, respectively, to permit pivotal movement of each arm element 28*a*, 28*b* with respect to the U-shaped rocker elements 20*a*, 20*b* between the operative starting position and the pair of second operative starting positions. The first toothed structures 38*a*, 38*b* include first toothed portions 42*a*, 42*b* adapted to receive second toothed portions 44*a*, 44*b* provided by the second toothed structures 40*a*, 40*b*. The first toothed portions 42*a*, 42*b* and second toothed portions 44*a*, 44*b* are configured and positioned such that they permit the interlocking relationship of the first toothed structures 38*a*, 38*b* and second toothed structures 40*a*, 40*b* only in the operative starting position and the pair of second operative starting positions.

Figure 6:
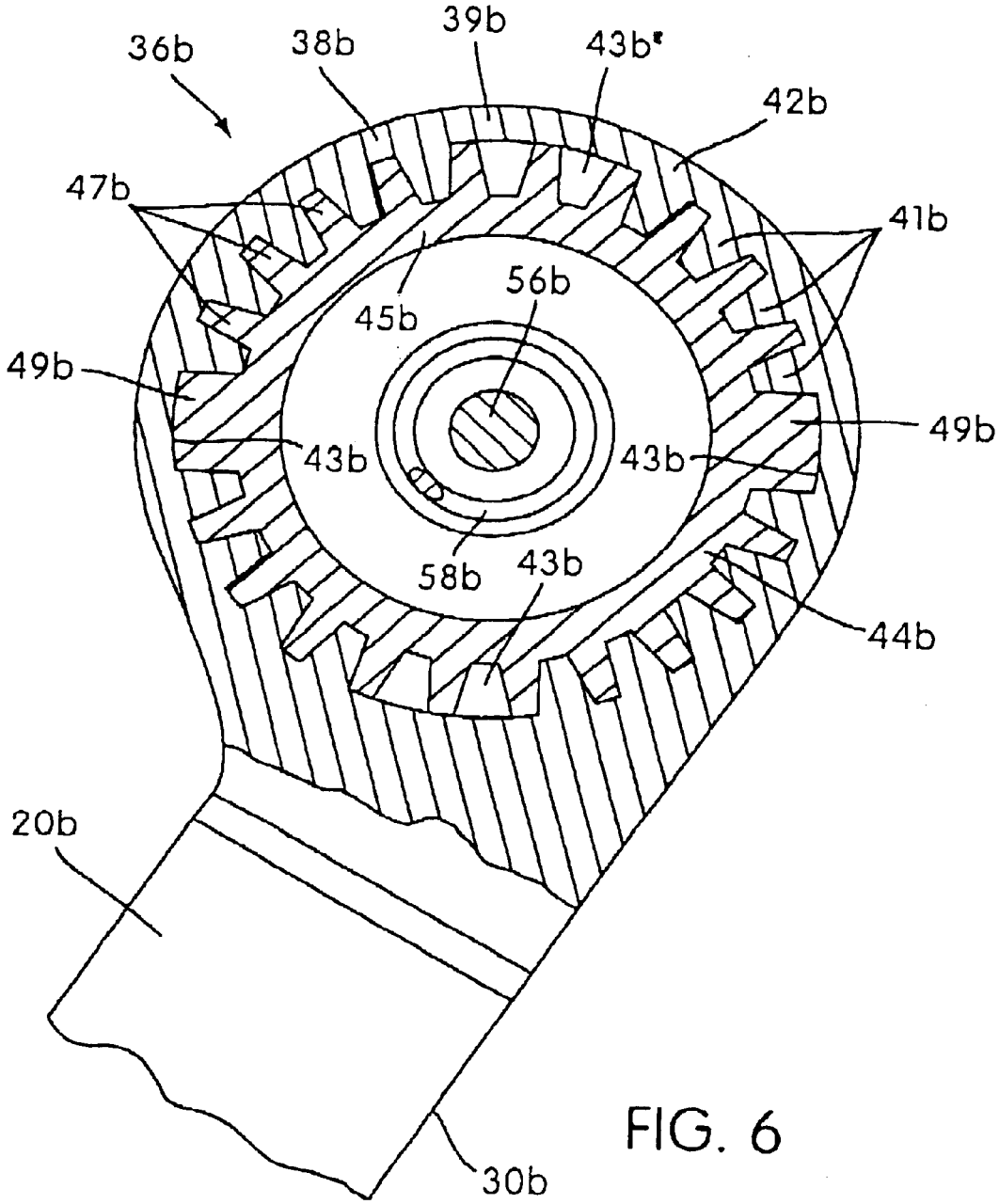
FIG. 6 is a cross-sectional view taken along line 6—6 of FIG. 1 showing the releasable adjusting assembly which enables adjustment of the hand grips between operative starting positions.

Specifically, referring now more particularly to FIG. 6, (which shows the left side of the exercise device along line 6—6 of FIG. 1, the right side being the mirror image thereof), the first toothed portions 42*a*, 42*b* have annular flanges 39*b*. The annular flanges 39*b* include a plurality of teeth 41*b* which are arranged on the inner periphery thereof. The teeth 41*b* are arranged in groups so as to define a pair of opposing enlarged gaps 43*b* between the groups. The second toothed portions 44*a*, 44*b* have annular flanges 45*b*. The annular flanges 45*b* include a plurality of teeth 47*b* and opposing enlarged teeth 49*b* arranged on the outer periphery thereof. The gaps 43*b* are sized and positioned such that the first toothed portions 42*a*, 42*b* and the second toothed portions 44*a*, 44*b* intermesh in interlocking relationship only when the opposing enlarged teeth 49*b* are received within one of the pair of opposing gaps 43*b*. FIG. 6 shows the engagement of the first toothed portions 42*a*, 42*b* and the second toothed portions 44*a*, 44*b* for the operative starting position. The other of the pair of gaps 43*b* is larger than the ones used for the operative starting position to enable movement of the opposing enlarged teeth within the opposing gaps 43*b* between the pair of second operative starting positions.

It is contemplated that the first toothed portions 42*a*, 42*b* and second toothed portions 44*a*, 44*b* may be constructed to permit any number of operative starting positions than those specified above.

In the illustrated embodiment, the first toothed structures 38*a*, 38*b* are fixed to the one ends 30*a*, 30*b* of the U-shaped rocker elements 20*a*, 20*b* and the second toothed structures 40*a*, 40*b* are fixed to the one end 32*a*, 32*b* of the arm elements 28*a*, 28*b*. Specifically, the first toothed structures 38*a*, 38*b* have first cylindrical portions 46*a*, 46*b* which are slidably received within the tubular one ends 30*a*, 30*b* of the U-shaped rocker elements 20*a*, 20*b*. The first cylindrical portions 46*a*, 46*b* are fixedly secured to the U-shaped rocker elements 20*a*, 20*b* by fasteners 48*a*, 48*b*. The fasteners 48*a*, 48*b* indicated in the figures include a nut, bolt, and washers, although any other fasteners, such as a screw, may be used which would fixedly secure the first cylindrical portions 46*a*, 46*b* to the U-shaped rocker elements 20*a*, 20*b*. The second toothed structures 40*a*, 40*b* have second cylindrical portions 50*a*, 50*b* which are slidably received within the tubular one ends 32*a*, 32*b* of the arm elements 28*a*, 28*b*. The second cylindrical portions 50*a*, 50*b* are fixedly secured to the arm elements 28*a*, 28*b* by fasteners 52*a*, 52*b*. The fasteners 52*a*, 52*b* indicated in the figures include a nut, bolt, and washers, although any other fasteners, such as a screw, may be used which would fixedly secure the second cylindrical portions 50*a*, 50*b* to the arm elements 28*a*, 28*b*. It is contemplated that the first toothed structures 38*a*, 38*b* are fixed to the arm element 28*a*, 28*b* and the second toothed structures 40*a*, 40*b* are fixed to the U-shaped rocker element 20*a*, 20*b*.

Figure 7:
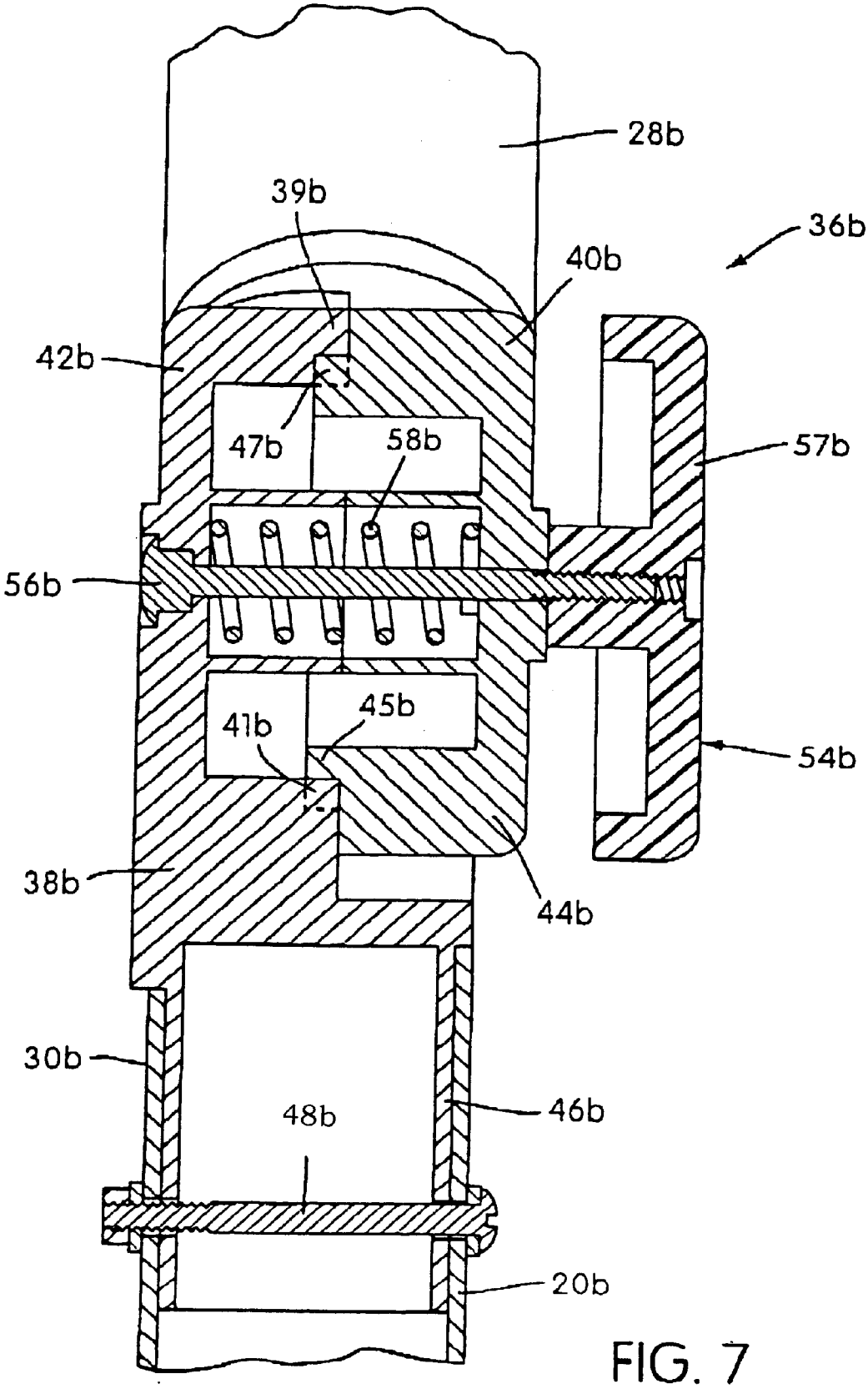
FIG. 7 is a cross-sectional view taken along line 7—7 of FIG. 1 showing the interlocking relationship of the first and second cooperating interlocking toothed structures of the releasable adjusting assembly.

Referring to FIG. 7, releasable locking mounts 54*a*, 54*b* lock the first toothed structures 38*a*, 38*b* and the second toothed structures 40*a*, 40*b* in the interlocking relationship. The releasable locking mounts 54*a*, 54*b* are comprised of bolts 56*a*, 56*b* and knobs 57*a*, 57*b*. The bolts 56*a*, 56*b* extend transversely through openings in the first toothed structures 38*a*, 38*b* and the second toothed structures 40*a*, 40*b* and cooperate with the knobs 57*a*, 57*b* to lock the first toothed structures 38*a*, 38*b* and the second toothed structures 40*a*, 40*b* in the interlocking relationship. Specifically, the knobs 57*a*, 57*b* have a threaded bore which receives the threaded portion of the bolts 56*a*, 56*b* therein. The knobs 57*a*, 57*b* should be securely tightened before performing exercises to avoid inadvertent movement of the hand grips 26*a*, 26*b*.

The first toothed structures 38*a*, 38*b* and the second toothed structures 40*a*, 40*b* are biased apart from one another by springs 58*a*, 58*b*. Thus, when the knobs 57*a*, 57*b* are released from the bolts 56*a*, 56*b*, the first toothed structures 38*a*, 38*b* and the second toothed structures 40*a*, 40*b* move out of interlocking relationship to permit pivotal movement of the second toothed structure 40*a*, 40*b* relative to the first toothed structures 38*a*, 38*b* about the bolts 56*a*, 56*b* in order to move the arm elements 28*a*, 28*b* and hence the hand grips 26*a*, 26*b* between the operative starting position and the pair of second operative starting positions.

Although the above-described releasable adjusting assemblies 36*a*, 36*b* are preferred because it provides easy adjustment between the operative starting position and the pair of second operative starting positions, it is contemplated that other assemblies may be used to provide releasable adjustment between the U-shaped rocker elements 20*a*, 20*b* and the arm elements 28*a*, 28*b*.

Figure 10:
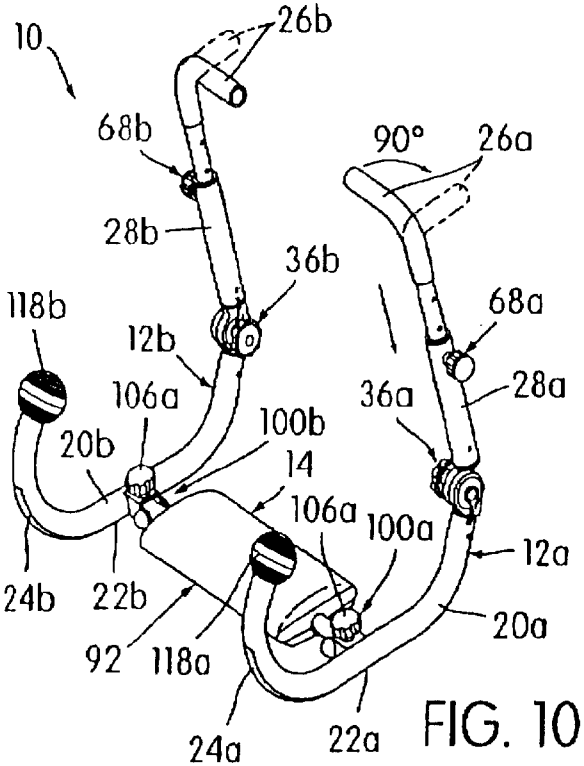
FIG. 10 is a perspective view showing the hand grips being moved from an operative position to a storage position with the storage position of the hand grips shown in phantom lines.

The pair of manually movable structures 12*a*, 12*b* include L-shaped elements 60*a*, 60*b* having first legs 62*a*, 62*b* and second legs 64*a*, 64*b*. In the illustrated embodiment, the L-shaped elements 60*a*, 60*b* are tubular. The first legs 62*a*, 62*b* of the L-shaped elements 60*a*, 60*b* provide the hand grips 26*a*, 26*b*. The second legs 64*a*, 64*b* are rotatably mounted in the opposite ends 34*a*, 34*b* of the arm elements 28*a*, 28*b* about the longitudinal axis thereof for movement between an operative position wherein the hand grip 26*a*, 26*b* providing first legs 62*a*, 62*b* extend toward one another, as shown in FIGS. 1–3, and a storage position wherein the hand grip 26*a*, 26*b* providing first legs 62*a*, 62b are displaced 90° in opposite directions from the operative position, as shown in FIG. 10 in phantom. Specifically, the opposite ends 34*a*, 34*b* of the arm elements 28*a*, 28*b* have plastic generally tubular bushings 66*a*, 66*b* which are received within the tubular opposite ends 34*a*, 34*b* with a friction fit. The second legs 64*a*, 64*b* are rotatably received within the bushings 66*a*, 66*b*, which bushings 66*a*, 66*b* facilitate movement of the second legs 64*a*, 64*b* with respect to the arm elements 28*a*, 28*b*. Moreover, the second legs 64*a*, 64*b* are releasably fixed into the operative and storage position by a releasable locking assembly 68*a*, 68*b*.

Figure 8:
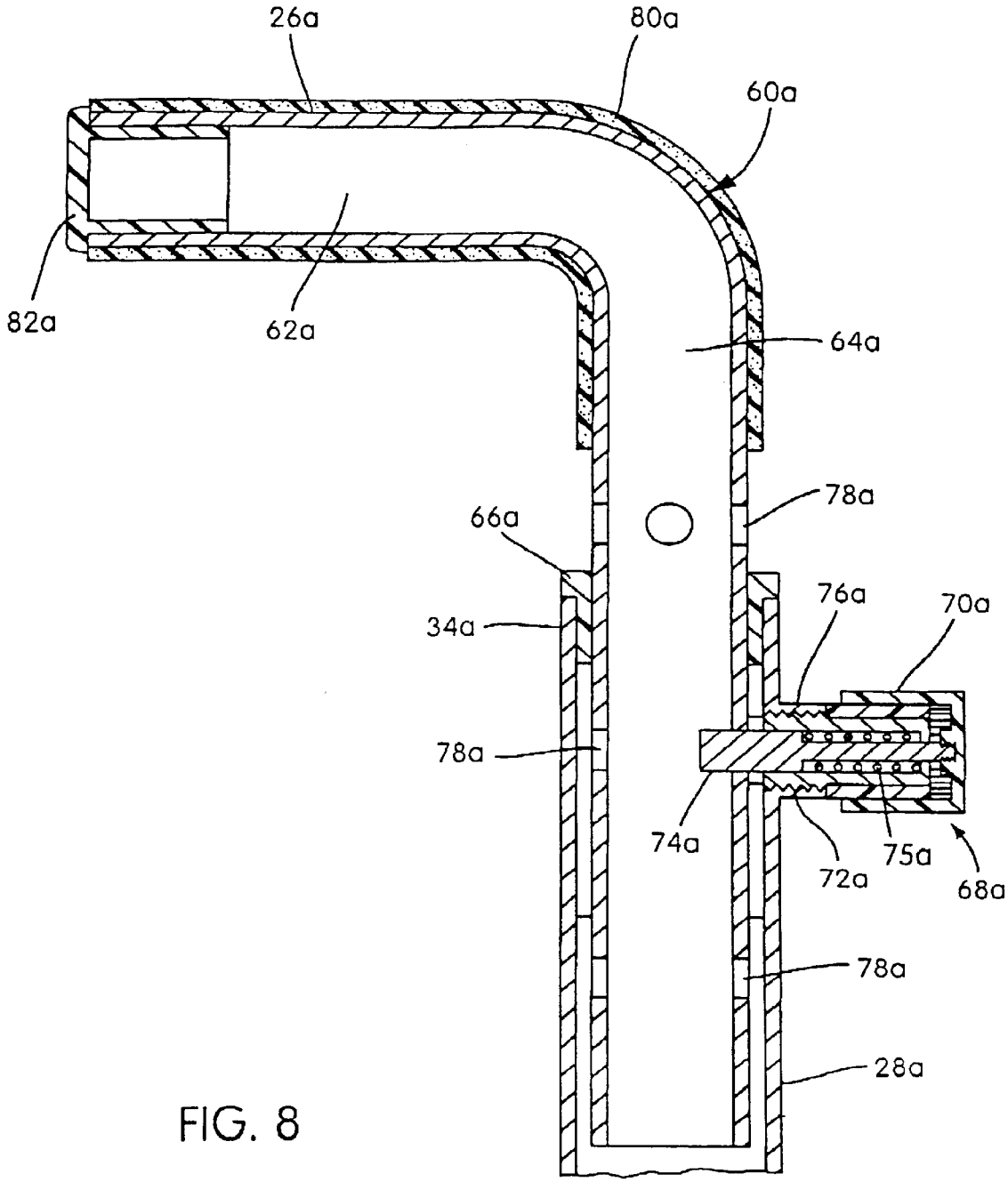
FIG. 8 is a cross-sectional view taken along line 8—8 of FIG. 1 showing the releasable locking assembly which secures the hand grips to arm elements of the exercise device.
Figure 9:
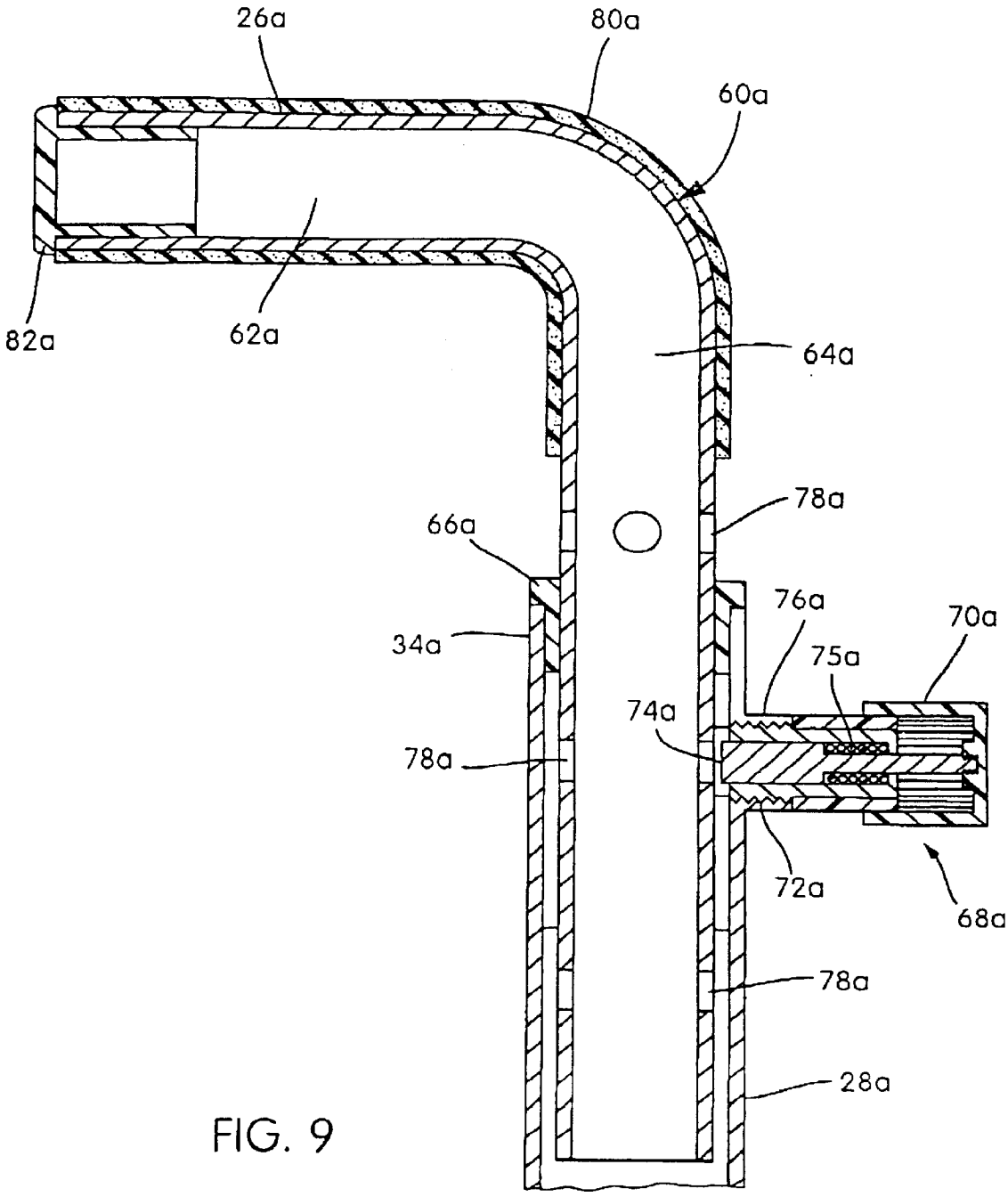
FIG. 9 is the cross-sectional view of FIG. 8 showing the releasable locking assembly released in order to adjust the hand grips between operative and storage positions.

FIG. 8 shows a cross-sectional view of the right side of the exercise device along line 8—8 of FIG. 1, the left side being the mirror image thereof. Referring to FIGS. 8–9, each releasable locking assembly 68*a*, 68*b* comprises a releasing knob 70*a*, 70*b* including an elongated pin 74*a*, 74*b* secured thereto and an arm element securing member 72*a*, 72*b*. The arm element securing member 72*a*, 72*b* has a threaded portion that is fixedly secured within a threaded opening 76*a*, 76*b* in the arm element 28*a*, 28*b*. The arm element securing member 72*a*, 72*b* is coupled to the releasing knob 70*a*, 70*b* to enable axial movement of the releasing knob 70*a*, 70*b* with respect to the arm element securing member 72*a*, 72*b* between locking and releasing positions. A spring 75*a* is operatively connected between the releasing knob 70*a*, 70*b* and the arm element securing member 72*a*, 72*b* constructed and arranged to bias the releasing knob 70*a*, 70*b* into the locking position wherein the pin 74*a*, 74*b* extends into one of a plurality of openings 78*a*, 78*b* provided in the second leg 64*a*, 64*b* to releasably lock the second leg 64*a*, 64*b*, and hence the hand grips 26*a*, 26*b*, in one of the operative and storage positions, as shown in FIG. 8. The releasing knob 70*a*, 70*b* is constructed and arranged to be manually moved against the biasing of the spring 75*a* thereof to move the same into the releasing position thereof wherein the pin 74*a*, 74*b* is moved out of the opening 78*a*, 78*b* in the second leg 64*a*, 64*b* in order to adjust the hand grips 26*a*, 26*b* between the operative and storage positions, as shown in FIG. 9.

The plurality of openings 78*a*, 78*b*, which are arranged radially and axially along the second legs 64*a*, 64*b*, also enables the hand grips 26*a*, 26*b* to be moved in incremental positions axially offset from the arm elements 28*a*, 28*b* to accommodate different sized users and grip preferences. Further, as shown sequentially in FIGS. 10–11 , the hand grips 26*a*, 26*b* may be moved in the direction of the arm elements 28*a*, 28*b* for storage purposes. Similarly, the plurality of openings enable the hand grips 26*a*, 26*b* to be displaced 180° from the operative position in order to provide a wider hand grip.

A gripping structure 80*a*, 80*b*, preferably made of foam, is secured to the hand grip 26*a*, 26*b*, by a friction fit or an adhesive for example, to provide a comfortable grip and to prevent sliding movement of the user's hands during an operative movement of the device 10 during an exercise. Further, plug members 82*a*, 82*b* are secured to ends of the first legs 62*a*, 62*b* of the L-shaped elements 60*a*, 60*b* for safety and aesthetics.

The user support structure 14 comprises a tubular member 84 having a transversely extending axis, a central portion 86 and opposite end portions 88, 90, as shown in FIG. 5. A cushion assembly 92 is mounted on the central portion 86 of the tubular member 84 for rotational movement about the axis thereof. Specifically, the cushion assembly 92 comprises a cushion portion 94 and a mounting portion 96. The cushion portion 94 and mounting portion 96 are secured together by a plurality of fasteners 98, such as screws, such that the central portion 86 is rotatably received therebetween. A releasably lockable pivotal connection 100*a*, 100*b* is provided between each end portion 88, 90 and a central portion 102*a*, 102*b* of an adjacent U-shaped rocker element 20*a*, 20*b*. Each releasably lockable pivotal connection 100*a*, 100*b* is constructed and arranged to enable the U-shaped rocker elements 20*a*, 20*b* to be fixedly locked in an operative position, as shown in FIGS. 1–3, wherein the U-shaped rocker elements 20*a*, 20*b* extend in spaced parallel relation with respect to one another with the tubular member 84 extending generally perpendicularly therebetween. The arm elements 28*a*, 28*b* form extensions of the U-shaped rocker elements 20*a*, 20*b* and the hand grips 26*a*, 26*b* extend inwardly toward one another with respect to the arm elements 20*a*, 20*b* and perpendicularly with respect to the U-shaped elements 20*a*, 20*b* in oppositely facing relation with respect to one another and in generally parallel relation to the tubular member 84. Each releasably lockable pivotal connection 100*a*, 100*b* also enables the U-shaped elements 20*a*, 20*b* to be releasably pivoted inwardly toward one another into a storage position, as shown in FIG. 12, wherein the arm elements 28*a*, 28*b* and the hand grips 26*a*, 26*b* are generally aligned with the U-shaped rocker elements 20*a*, 20*b* which extend inwardly toward one another in adjacent relation alongside the cushion assembly 92.

Each releasably lockable pivotal connection 100*a*, 100*b* comprises a mounting portion 104*a*, 104*b* and a locking member 106*a*, 106*b*, as shown in FIG. 5. The mounting portion 104*a*, 104*b* includes a pair of parallel arm members fixed to the central portion 102*a*, 102*b* of the U-shaped rocker element 20*a*, 20*b*. Each pair of arm members is spaced so as to receive adjacent end portions 88, 90 of the tubular member 84 in pivotally mounted relation therebetween to allow relative pivotal movement between the associated U-shaped rocker element 20*a*, 20*b* and the adjacent end portion 88, 90 of the tubular member 84 between the operative and storage positions. Each pair of arm members and the adjacent end portions 88, 90 of the tubular member 84 are pivotally mounted by a pivot pin 108*a*, 108*b* extending transversely therethrough. The pivot pin 108*a*, 108*b* indicated in the figures include a nut, bolt, and washers, although any other pivot pin may be used which would pivotably secure the U-shaped rocker elements 20*a*,

20*b* to the tubular member 84. In the figures, a plastic cap 110*a*, 110*b* is mounted over the nut for safety and aesthetics. The locking member 106*a*, 106*b* is movable between a locking position (FIG. 10) and a releasing position (FIGS. 11–12) and has a threaded shaft secured thereto which extends through an opening in the mounting portion 104*a*, 104*b* and into a threaded opening of the adjacent end portion 88, 90 of the tubular member 84 when the locking member 106*a*, 106*b* is in the locking position (FIG. 10) thereof to releasably lock the associated U-shaped rocker element 20*a*, 20*b* in the operative position thereof. The threaded shaft of the locking member 106*a*, 106*b* is removed from the threaded opening of the adjacent end portion 88, 90 and the opening in the mounting portion 104*a*, 104*b* when the locking member 106*a*, 106*b* is in the releasing position (FIGS. 11–12) thereof enabling the associated U-shaped rocker elements 20*a*, 20*b* to be pivoted to the storage position.

Figure 11:
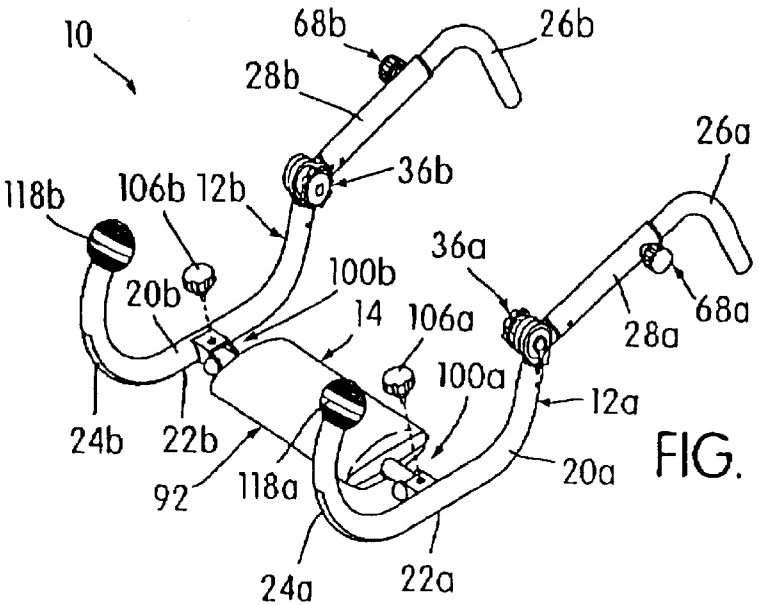
FIG. 11 is a perspective view showing the hand grips moved to the storage position as shown in FIG. 10 and adjusted to the operative starting position as shown in FIG. 1 with locking members of the releasably lockable pivotal connection removed.
Figure 12:
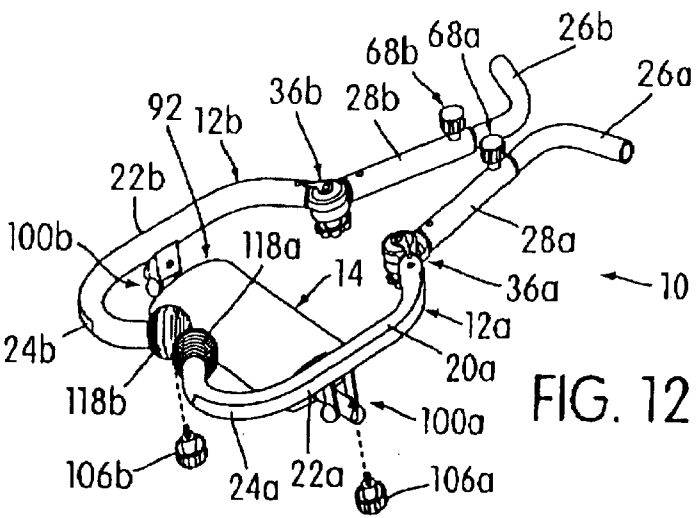
FIG. 12 is a perspective view showing the device as shown in FIG. 11 with the U-shaped elements pivoted inwardly toward one another into a storage position.

Specifically, in order to move the device 10 to the storage position as shown in FIG. 12, the hand grips 26*a*, 26*b* are pivoted 90 degrees from the operative position to the storage position and moved axially in the direction of the arm elements 28*a*, 28*b*, as shown sequentially in FIGS. 10–11. The arm elements 28*a*, 28*b* are adjusted to the operative starting position, as shown in FIG. 11, if not already in that position. The locking members 106*a*, 106*b* are removed such that the U-shaped elements 20*a*, 20*b* may be pivoted to the storage position. The locking members 106*a*, 106*b* may be inserted through the transverse bores at the end portions 88, 90 of the tubular member 84 for storage purposes, as shown in FIG. 12.

Although the above-described releasable lockable pivotal connection 100*a*, 100*b* is preferred because it provides easy adjustment between the operative and storage positions, it is contemplated that other connections may be used to provide a pivotal connection between the U-shaped rocker elements 20*a*, 20*b* and the tubular member 84 that is releasably lockable.

Figure 13:
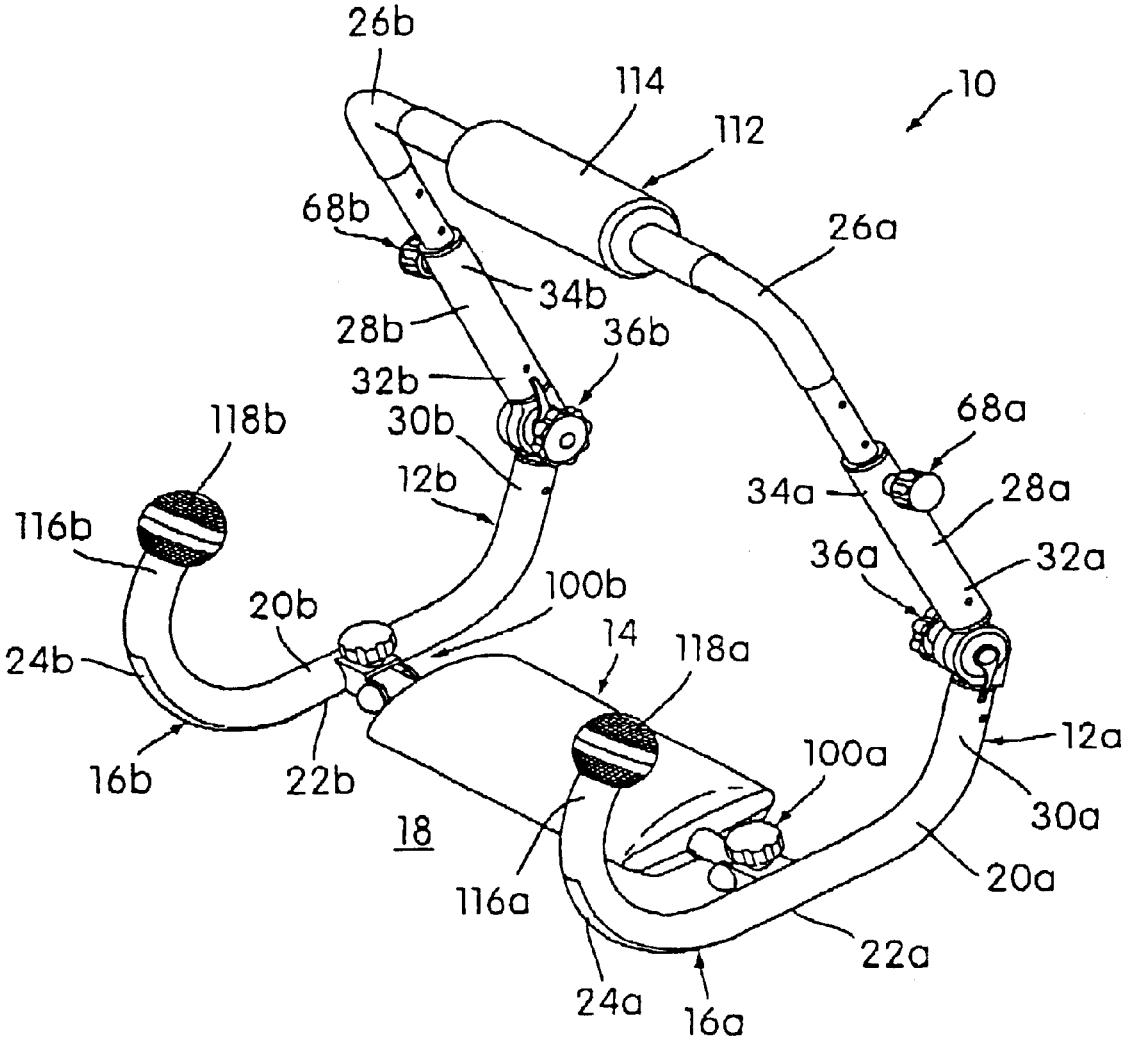
FIG. 13 is a perspective view showing the device as shown in FIG. 2 with a bridging member mounted over the hand grips.
Figure 30:
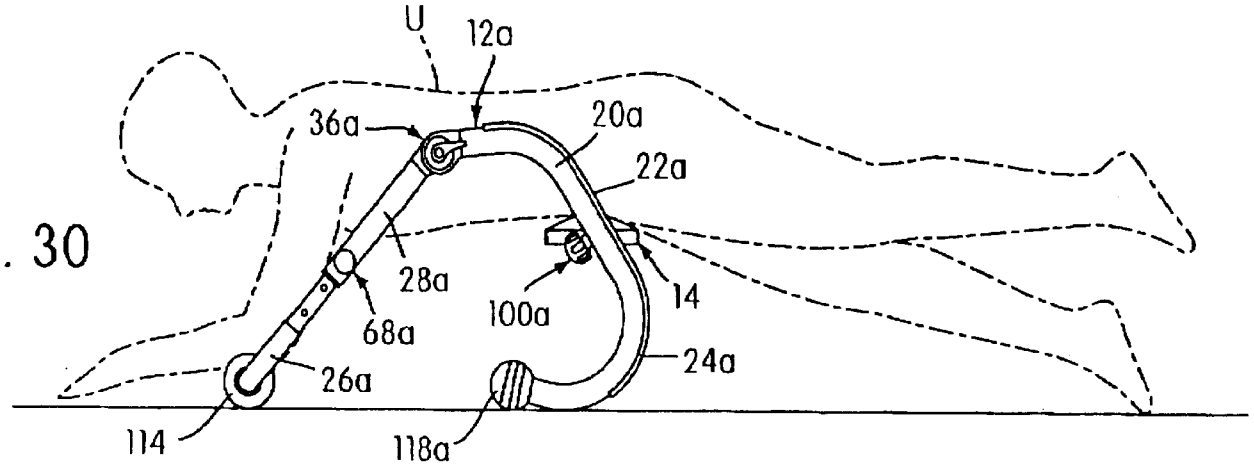
FIG. 30 is a side view of the device with the user support structure in an elevated position over the horizontal surface with a user shown in phantom lines supported on the user support structure by the lower abdominal region.
Figure 31:
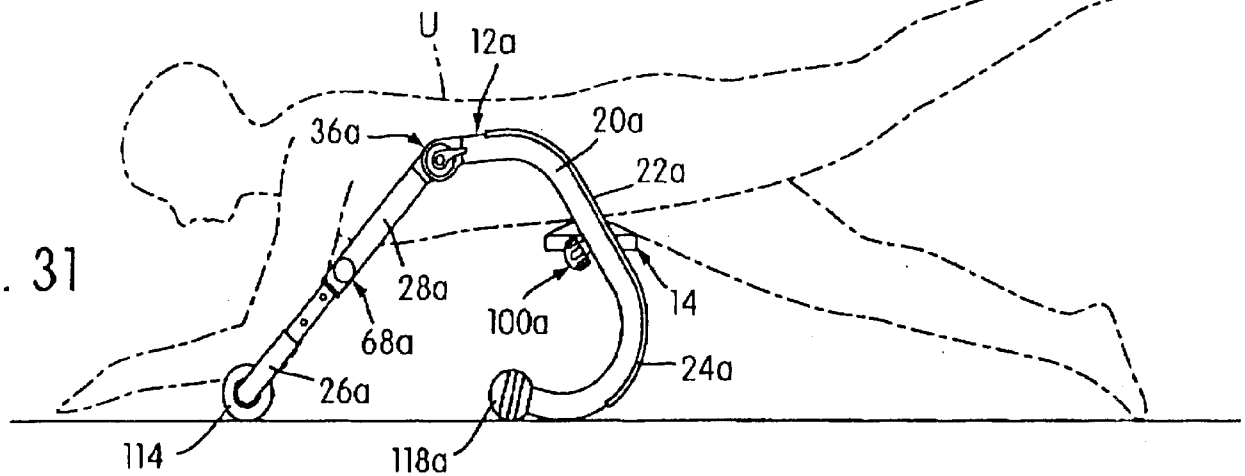
FIG. 31 is the side view of FIG. 30 showing the user performing leg lifts.

The physical exercises performed with the exercise device 10 will now be described in greater detail. Various exercises are described below in connection with different adjustments of the device 10. As the user moves from exercise to exercise, adjustments to the hand grips 26*a*, 26*b*, arm elements 28*a*, 28*b*, and user support structure 14 may need to be performed. Specifically, the exercises illustrated in FIGS. 14–19 are performed with the hand grips 26*a*, 26*b* in the operative starting position. The variety of exercises illustrated in FIGS. 20–23 are executed with the hand grips 26*a*, 26*b* in one of the pair of second operative starting positions. The exercises shown in FIGS. 24–29 are performed with the hand grips 26*a*, 26*b* in one of the pair of second operative starting position and a bridging member 112, as shown in FIG. 13, mounted over the hand grips 26*a*, 26*b*, as will be further discussed. The exercise described in FIGS. 30–31 is performed with the user support structure 14 elevated over the horizontal surface 18.

Figure 14:
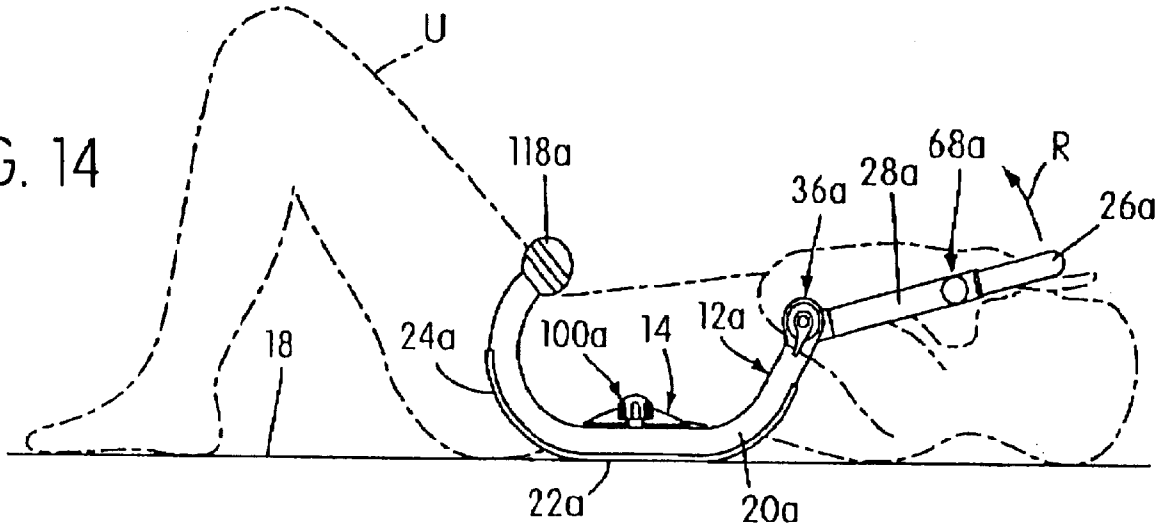
FIG. 14 is a side view of the device as shown in FIG. 1 with a user shown in phantom lines supported on the user support structure in a supine position, the hand grips are grasped by the user with the arms disposed upwardly and bent at the elbows.

Referring now more particularly to FIG. 14, the user support structure 14 is constructed and arranged when in an operative starting position to support a user U in a supine position wherein the user U is disposed in supine relation on the horizontal surface 18 with the knees bent upwardly and the lower back supported on the user support structure 14 disposed adjacent the horizontal surface 18. The hand grips 26*a*, 26*b* are disposed in the operative starting position above the horizontal surface 18 at a level to be grasped by the user U in the supine position with the arms disposed upwardly and bent at the elbows.

Figure 15:
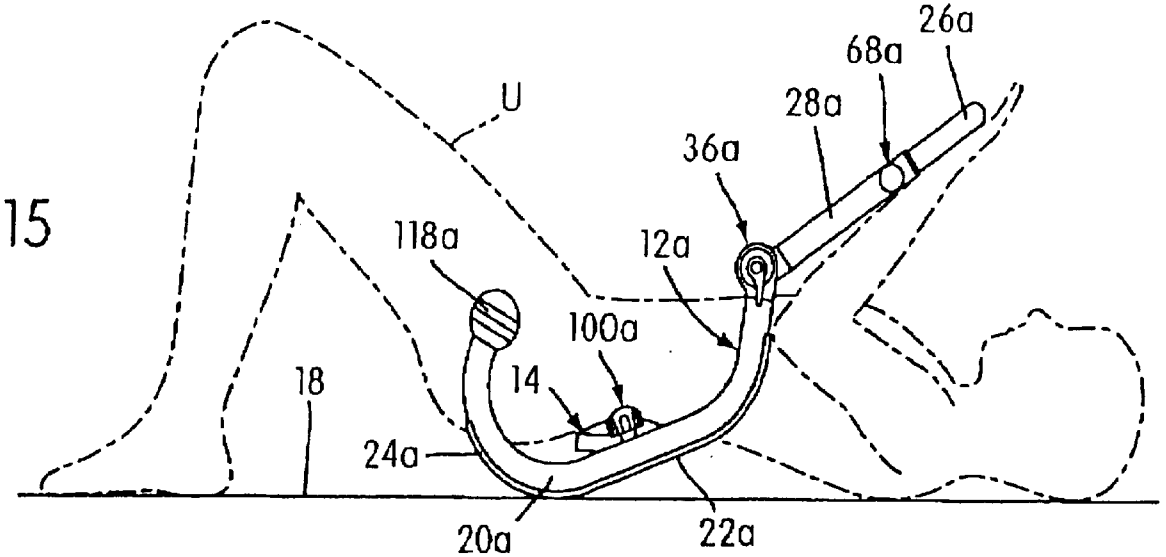
FIG. 15 is the side view of FIG. 14 showing the user effecting a rearward operative movement of the hand grips by extending the arms.

The convex surfaces 22*a*, 22*b* of the rocker elements 20*a*, 20*b* of the pair of manually movable structures 12*a*, 12*b* are configured and positioned so that a rearward operative movement of the hand grips 26*a*, 26*b* away from the operative starting position in a rearward direction R will move the user support structure 14 upwardly from the operative starting position thereof, as shown in FIG. 15. The user U in the supine position effects the rearward operative movement of the hand grips 26*a*, 26*b* in the rearward direction R by extending the user's arms. The rearward operative movement is resisted by the user's supported weight on the user support structure 14. A return movement is also manually resisted by the supported weight of the user U on the user support structure 14. This exercise shown in FIGS. 14–15 exercises the lower abdominal muscles and buttocks with a lower backstretch.

Figure 16:
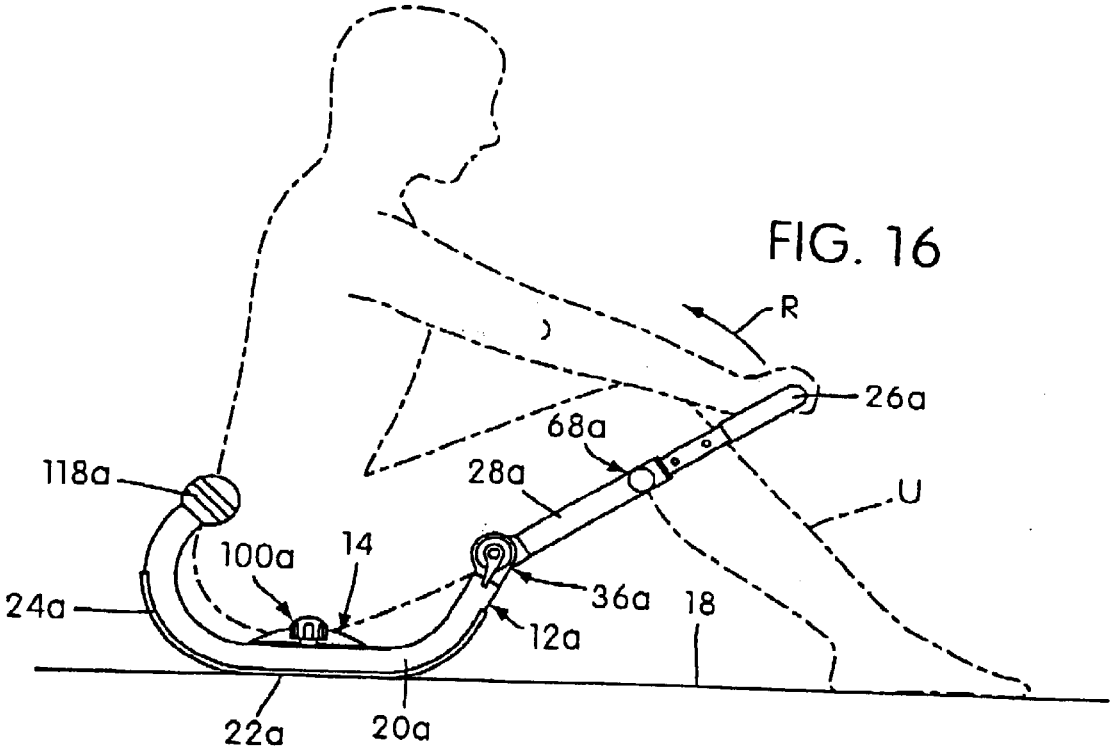
FIG. 16 is a side view of the device as shown in FIG. 1 with a user shown in phantom lines supported on the user support structure in a seated position, the hand grips are grasped by the user with the arms extending outwardly.
Figure 18:
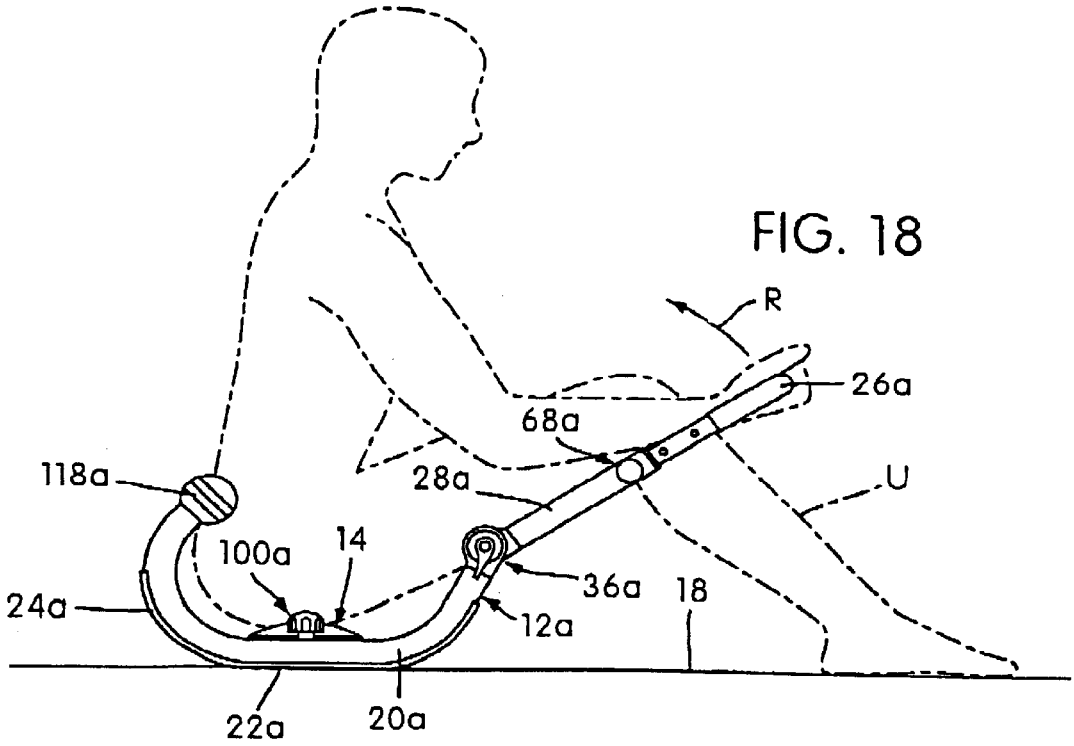
FIG. 18 is a side view of the device as shown in FIG. 1 with a user shown in phantom lines supported on the user support structure in a seated position, the hand grips are grasped by the user with the arms extending outwardly.

Referring now more particularly to FIGS. 16 and 18, the user support structure 14 is constructed and arranged when in an operative starting position to support a user U in a seated position wherein the user U is disposed in seated relation on the user support structure 14 disposed adjacent the horizontal surface 18 with legs extended and bent at the knees and the feet resting on the horizontal surface 18. The hand grips 26*a*, 26*b* are disposed in the operative starting position above the horizontal surface 18 at a level to be grasped by the user U in the seated position with the arms extending outwardly.

Figure 17:
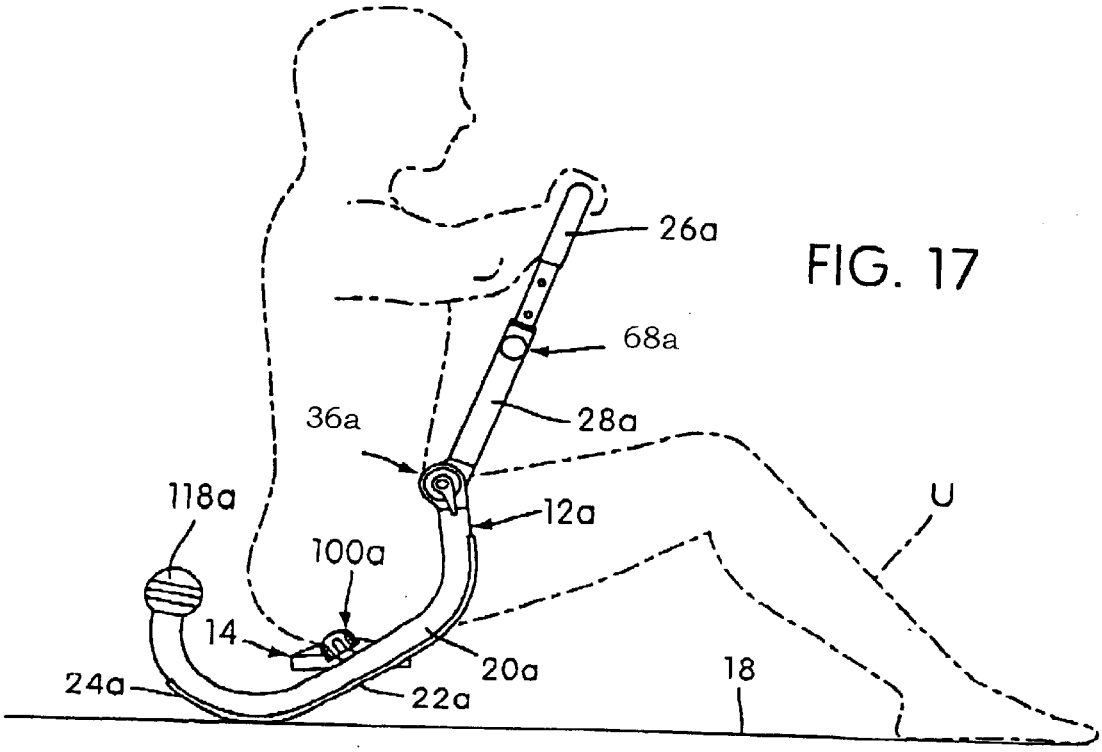
FIG. 17 is the side view of FIG. 16 showing the user effecting a rearward operative movement of the hand grips by a pull with palms down and elbows out.
Figure 19:
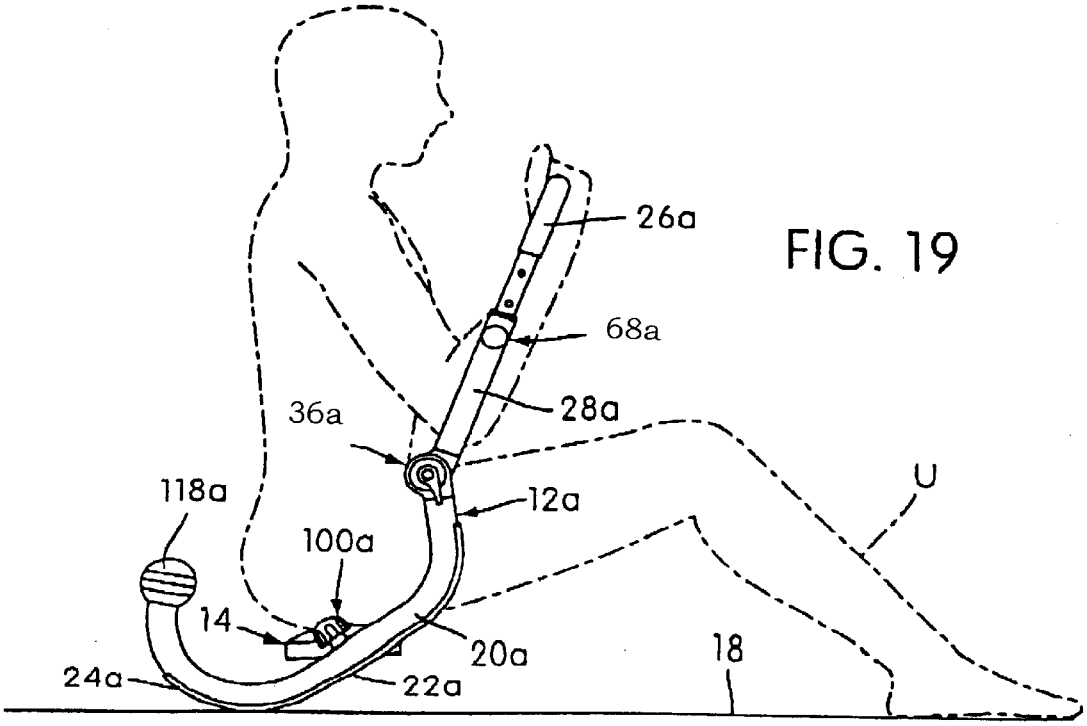
FIG. 19 is the side view of FIG. 18 showing the user effecting a rearward operative movement of the hand grips by a curl with palms up and elbows down.

As described above, the rearward operative movement of the hand grips 26*a*, 26*b* away from the operative starting position in the rearward direction R will move the user support structure 14 upwardly from the operative starting position thereof. The user U in the seated position effects the rearward operative movement of the hand grips 26*a*, 26*b* in the rearward direction R by a pull with palms down and elbows out, as shown in FIG. 17, or a curl with palms up and elbows down, as shown in FIG. 19. The rearward operative movement is resisted by the user's supported weight on the user support structure 14. A return movement is also manually resisted by the supported weight of the user U on the user support structure 14. The pull with palms down and elbows out exercise (shown in FIGS. 16–17), also referred to as an upright row, exercises the shoulders and upper-back muscles. The curl with palms up and elbows down exercise (shown in FIGS. 18–19), also referred to as a biceps curl, exercises the biceps.

Figure 20:
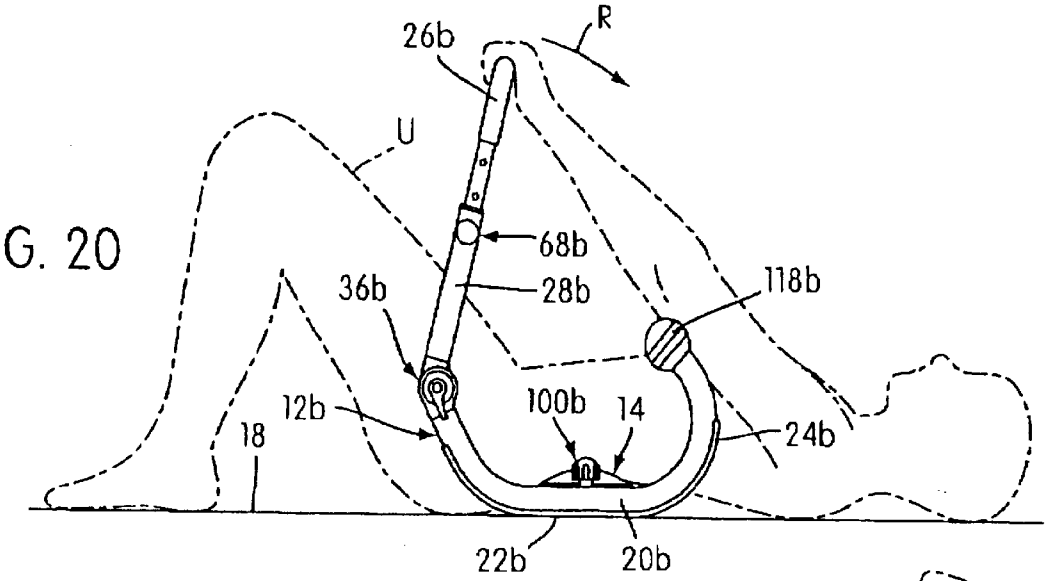
FIG. 20 is a side view of the device as shown in FIG. 2 with a user shown in phantom lines supported on the user support structure in a reverse supine position, the hand grips are grasped by the user with the arms extending upwardly and outwardly.

Referring now more particularly to FIG. 20, the user support structure 14 is constructed and arranged when in the operative starting position to support a user U in the same manner as the supine position but in a reverse supine position on the user support structure 14 wherein the user U is disposed in reverse supine relation on the horizontal surface 18 with the knees bent upwardly and the lower back supported on the user support structure 14 disposed adjacent the horizontal surface 18.

Figure 21:
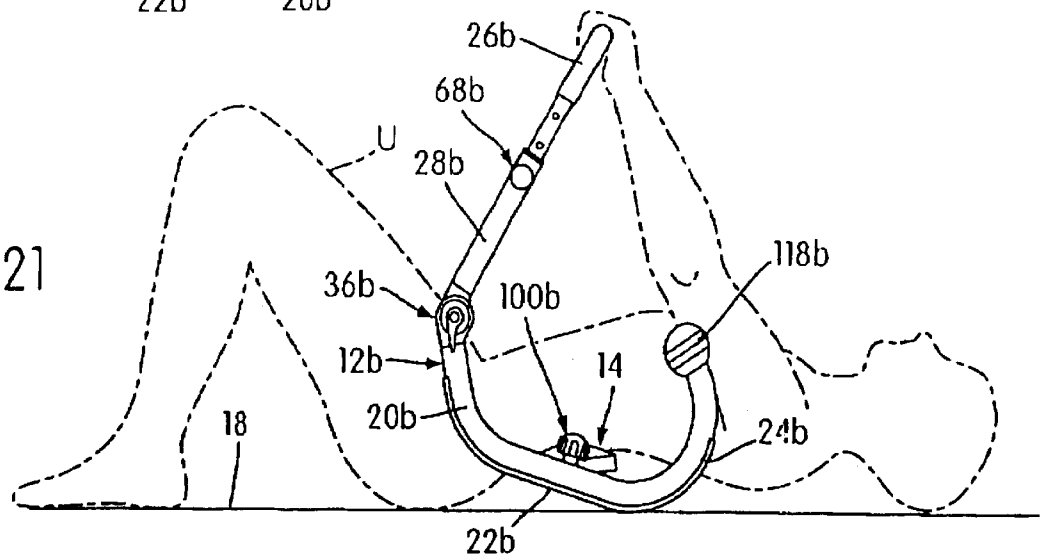
FIG. 21 is the side view of FIG. 20 showing the user effecting a rearward operative movement of the hand grips by pulling down on the hand grips.

The hand grips 26*a*, 26*b* are moved into the second operative starting position with respect to the U-shaped rocker elements 20*a*, 20*b* and the user support structure 14. The hand grips 26*a*, 26*b* in the second operative starting position are disposed at a level above the horizontal surface 18 to be grasped by the user U in the reverse supine position with the arms extended upwardly and outwardly. The user U in the reverse supine position effects a rearward operative movement of the hand grips 26*a*, 26*b* in the rearward direction R by pulling down on the hand grips 26*a*, 26*b*, as shown in FIG. 21. The rearward operative movement is resisted by the user's supported weight on the user support structure 14. A return movement is also manually resisted by the supported weight of the user U on the user support structure 14. This exercise shown in FIGS. 20–21 exercises the lower abdominal muscles and buttocks with a lower backstretch.

Figure 22:
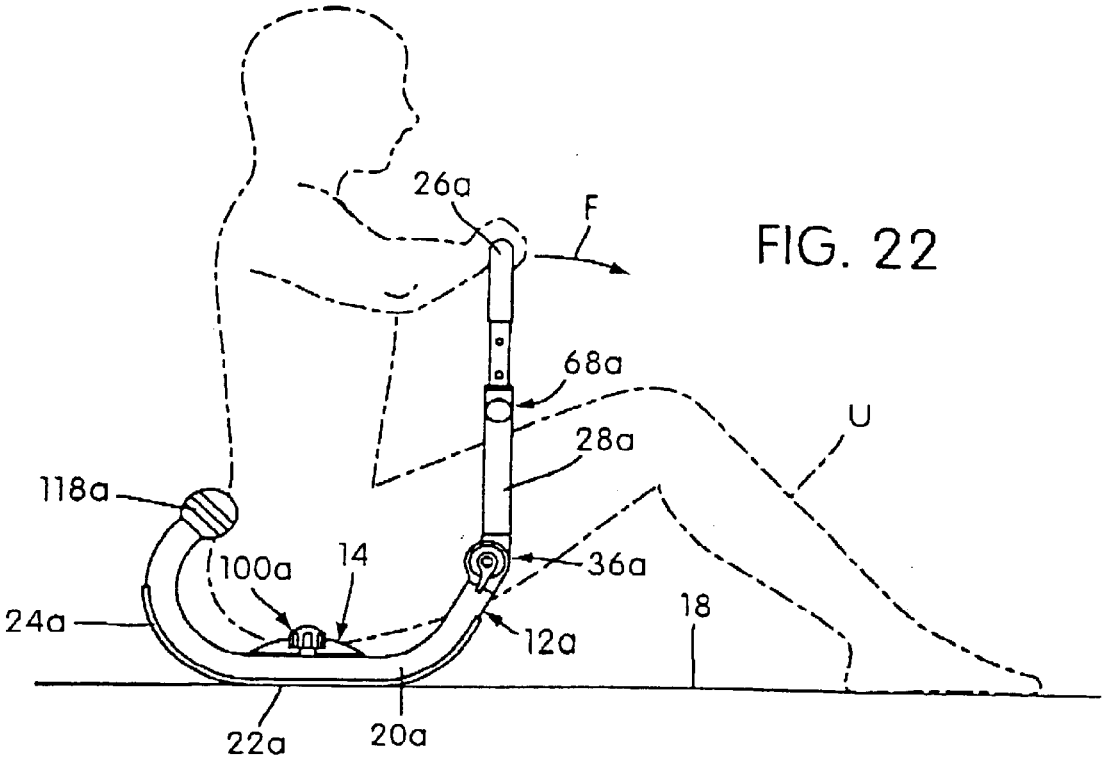
FIG. 22 is a side view of the device as shown in FIG. 2 with a user shown in phantom lines supported on the user support structure in a seated position, the hand grips are grasped by the user with the arms disposed outwardly and bent at the elbows.

Referring now more particularly to FIG. 22, the hand grips 26*a*, 26*b* in the second operative starting position are disposed at a level above the horizontal surface 18 to be grasped by a user U in the seated position with the arms disposed outwardly and bent at the elbows.

Figure 23:
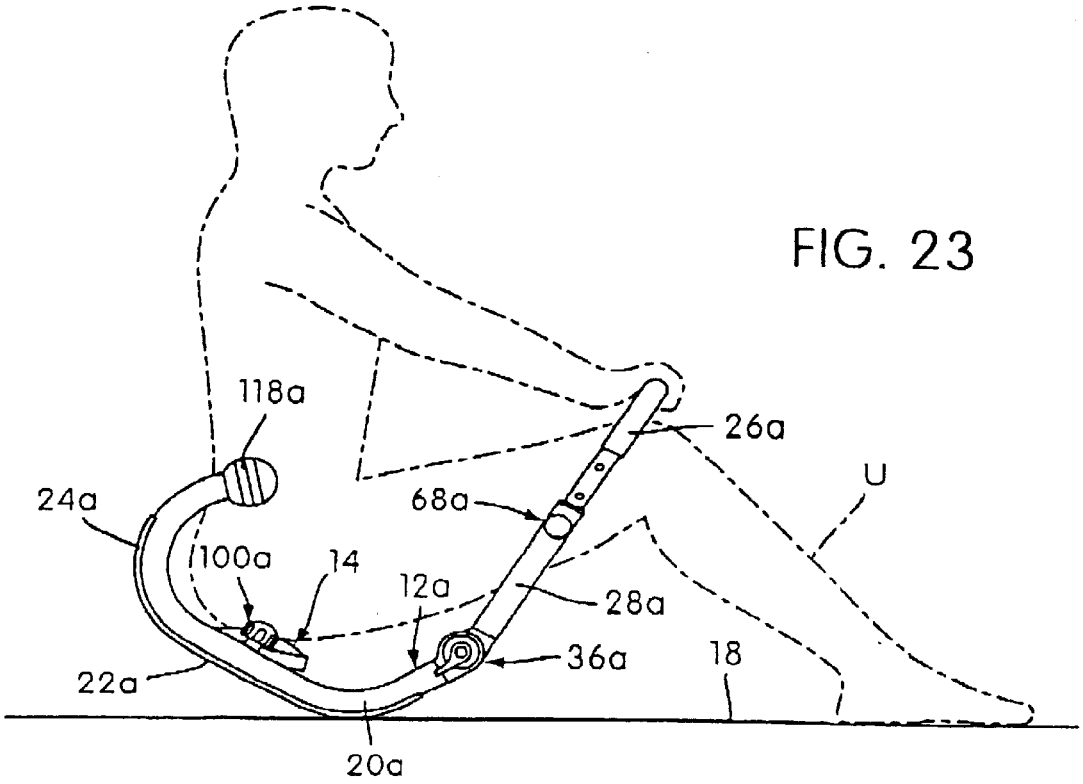
FIG. 23 is the side view of FIG. 22 showing the user effecting a forward operative movement of the hand grips by extending the arms outwardly.

The convex surfaces 22*a*, 22*b* of the rocker elements 20*a*, 20*b* of the pair of manually movable structures 12*a*, 12*b* are configured and positioned so that a forward operative movement of the hand grips 26*a*, 26*b* away from the second operative starting position in a forward direction F will move the user support structure 14 upwardly from the operative starting position thereof. The user U in the seated position effects the forward operative movement by extending the user's arms, as shown in FIG. 23. The forward operative movement is resisted by the user's supported weight on the user support structure 14. A return movement is manually resisted by the supported weight of the user U on the user support structure 14. This exercise (shown in FIGS. 22–23), also referred to as a chest press, exercises the chest or pectoral muscles.

Referring now more particularly to FIG. 13, the bridging member 112 may be mounted over the hand grips 26*a*, 26*b* to prepare the device 10 for a different set of exercises. Specifically, the hand grips 26*a*, 26*b* when in the second operative starting position include free ends facing toward one another in spaced relation and the bridging member 112, which is tubular, is selectively telescopically mounted over the hand grips 26*a*, 26*b* so as to extend in the space therebetween. Specifically, to mount the bridging member 112, one end of the bridging member 112 is telescopically mounted over one hand grip 26*a* or 26*b* and slided thereon as far as it can move. Then, the opposite end of the bridging member 112 is telescopically mounted over the opposite hand grip 26*b* or 26*a*. The bridging member 112 is moved toward the opposite hand grip 26*b* or 26*a* until it is evenly mounted on both hand grips 26*a*, 26*b*. The bridging member 112 has a cushioned central portion 114.

Figure 24:
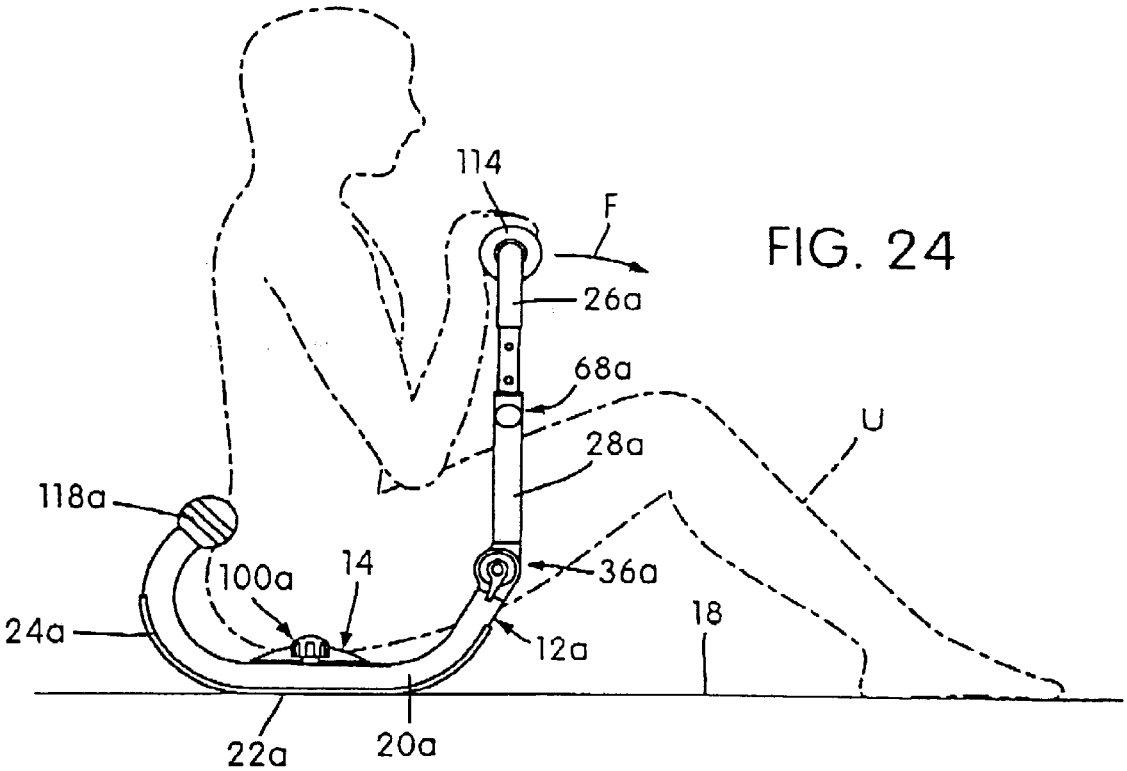
FIG. 24 is a side view of the device as shown in FIG. 13 with a user shown in phantom lines supported on the user support structure in a seated position, the cushioned central portion of the bridging member is grasped by the user.
Figure 25:
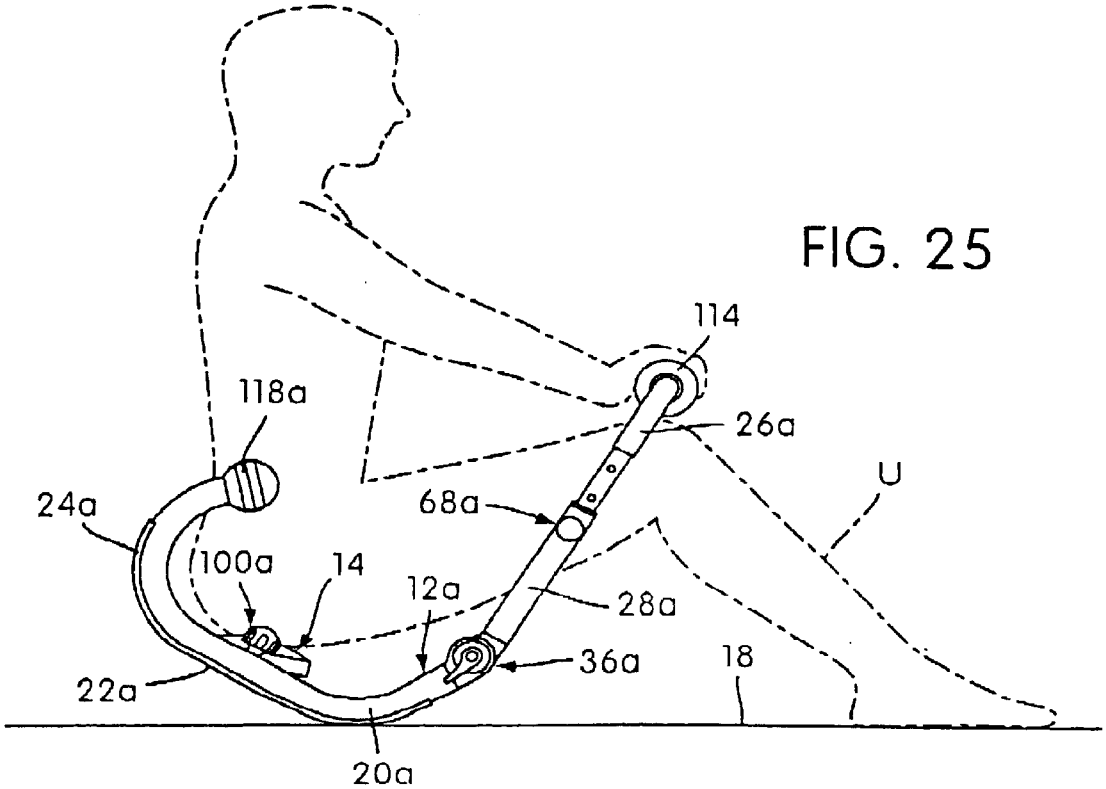
FIG. 25 is the side view of FIG. 24 showing the user effecting a forward operative movement by extending the arms outwardly.

Referring now more particularly to FIGS. 24–25, the configuration and position of the cushioned central portion 114 with respect to the hand grips 26*a*, 26*b* and the configuration of the convex surfaces 22*a*, 22*b* enables a user U in the seated position to grasp the cushioned central portion 114 and to effect the forward operative movement by extending the arms outwardly which moves the hand grips 26*a*, 26*b* away from the second operative starting position in the forward direction F, as shown in FIG. 25. The forward operative movement is resisted by the user's supported weight on the user support structure 14. A return movement is manually resisted by the supported weight of the user U on the user support structure 14. This exercise shown in FIGS. 24–25, also referred to as a tricep extension, exercises the tricep muscle.

Figure 26:
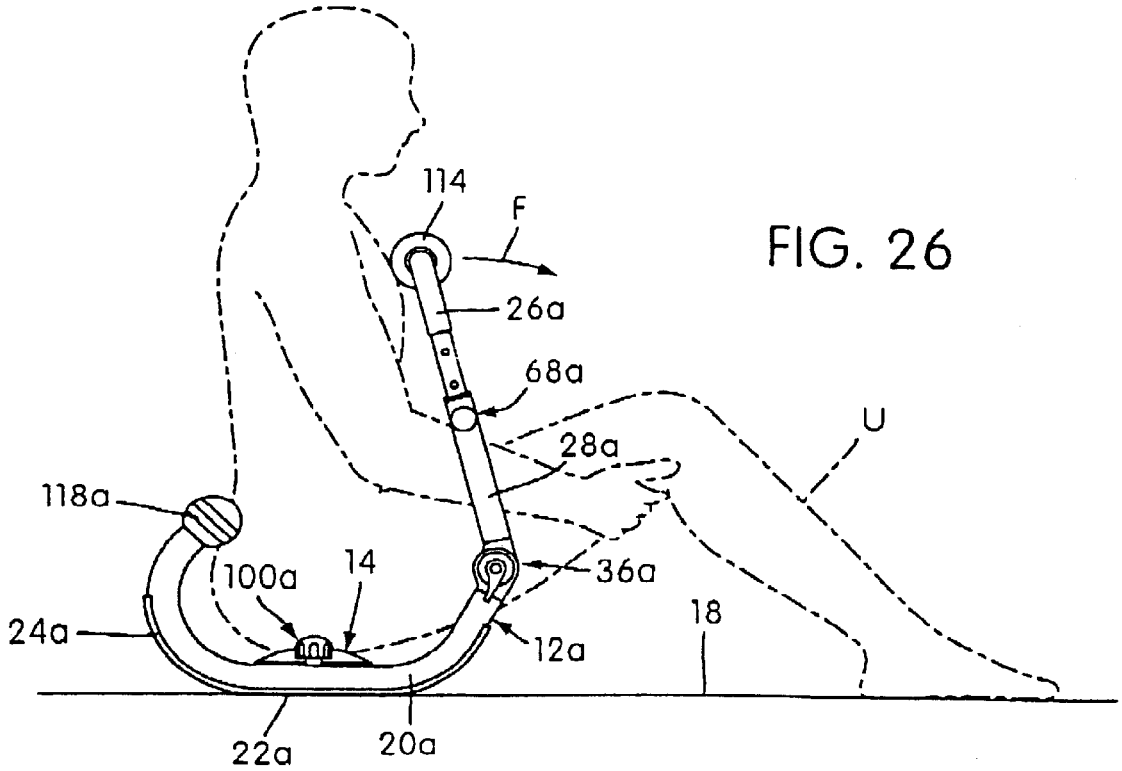
FIG. 26 is a side view of the device as shown in FIG. 13 with a user shown in phantom lines supported on the user support structure in a seated position with the arms down and chest moved forwardly into the centrally cushioned bridging member.
Figure 27:
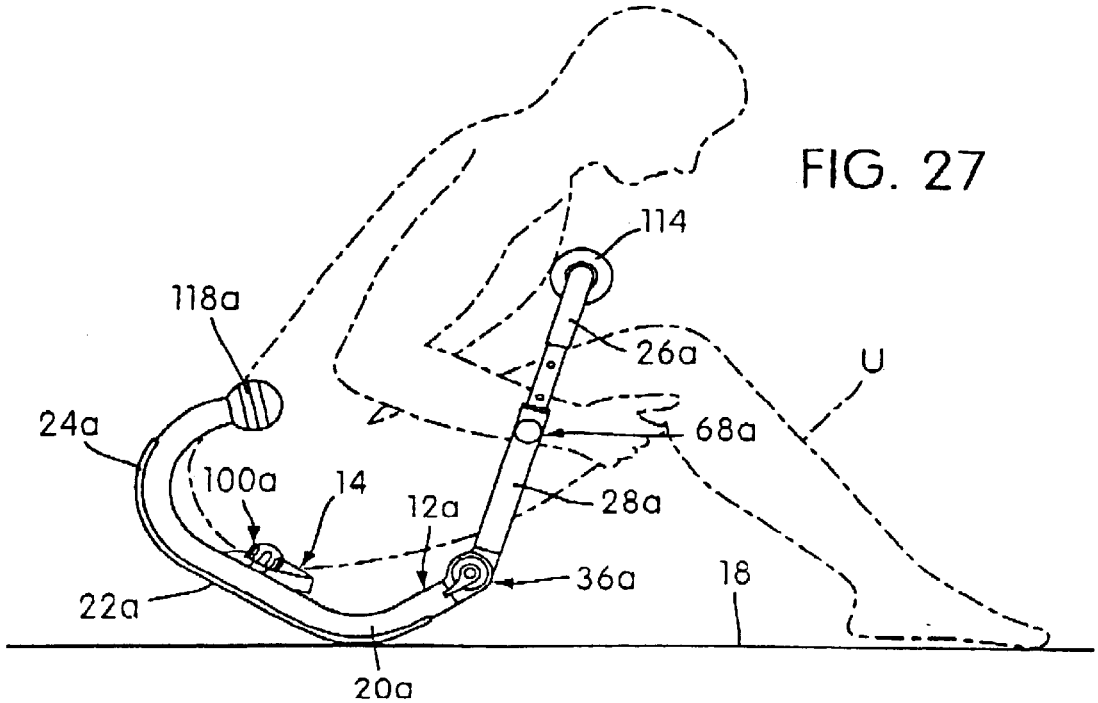
FIG. 27 is the side view of FIG. 26 showing the user effecting a forward operative movement by continued forward movement of the user's chest.

Referring now more particularly to FIGS. 26–27, the user U in the seated position but with arms down may move his/her chest forwardly into the cushioned central portion 114 of the centrally cushioned bridging member 112 so as to effect the forward operative movement by the continued forward movement of the chest of the user U which moves the hand grips 26*a*, 26*b* away from the second operative starting position in the forward direction F, as shown in FIG. 27. The forward operative movement is resisted by the user's supported weight on the user support structure 14. A return movement is resisted by chest contact by the supported weight of the user U on the user support structure 14. This exercise shown in FIGS. 26–27, also referred to as an abdominal crunch, exercises the abdominal muscles.

Figure 28:
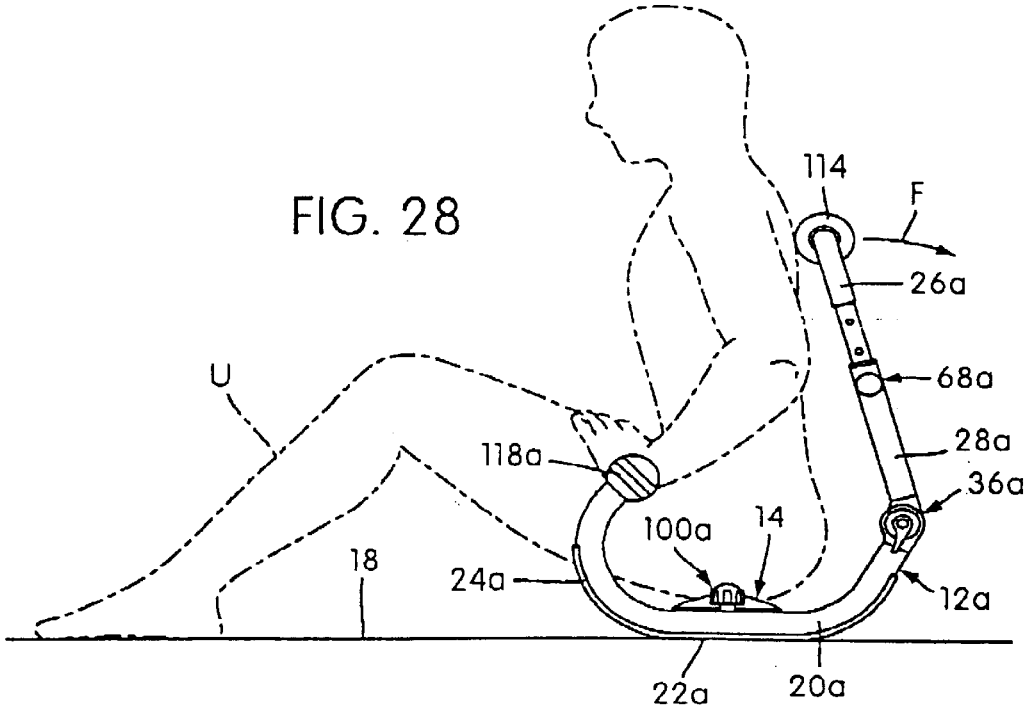
FIG. 28 is a side view of the device as shown in FIG. 13 with a user shown in phantom lines supported on the user support structure in a reverse seated position with the user's back moved rearwardly into the centrally cushioned bridging member.
Figure 29:
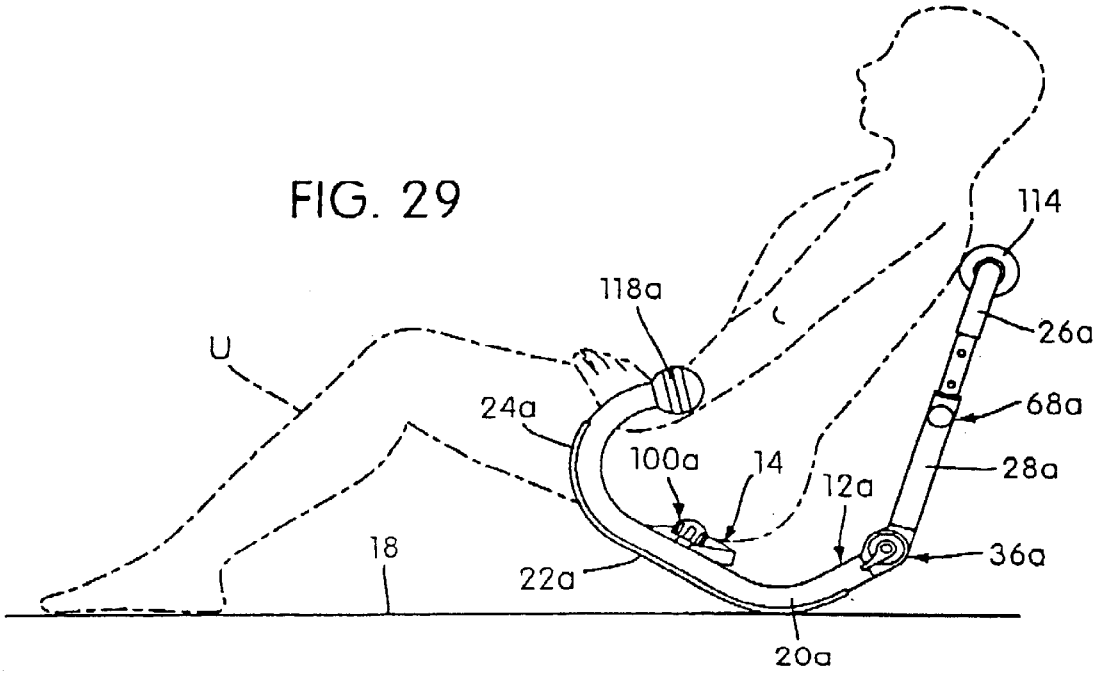
FIG. 29 is the side view of FIG. 28 showing the user effecting a forward operative movement by continued rearward movement of the user's back.

Referring now more particularly to FIGS. 28–29, the user U seated in the same manner as the seated position but in a reverse seated position on the user support structure 14 may move his/her back rearwardly into the cushioned central portion 114 to effect the forward operative movement by the continued rearward movement of the user's back which moves the hand grips 26*a*, 26*b* away from the second operative starting position in the forward direction F, as shown in FIG. 29. The forward operative movement is resisted by the user's supported weight on the user support structure 14. A return movement is resisted by back contact by the supported weight of the user U on the user support structure 14. This exercise shown in FIGS. 28–29, also referred to as a lower back extension, exercises the lower-back muscles. It is preferable that the user U rests his/her hands either on top of his/her thighs as shown or on enlarged alternative support elements 118*a*, 118*b* provided on opposite ends 116*a*, 116*b*, or free ends, of the U-shaped rocker elements 20*a*, 20*b*.

Referring now more particularly to FIG. 30, the support elements 118*a*, 118*b* are constructed and arranged to cooperate with the cushioned central portion 114 to alternatively engage the horizontal surface 18 and support the user support structure 14 in an elevated position over the horizontal surface 18. This positioning of the device 10 enables a user U to perform leg lifts while being supported by the lower abdominal region on the user support structure 14, as shown in FIG. 31. This exercise shown in FIGS. 30–31 exercises the buttocks, hips, and thighs. It is preferable to use the centrally cushioned bridging member 112 so that the user U may rest his/her elbows thereon with his/her hands on the horizontal surface 18. However, the bridging member 112 is not required to perform this exercise as the hand grips 26*a*, 26*b* can cooperate by themselves with the support elements 118*a*, 118*b* to elevate the user support structure 14.

As described above, resistance is provided by the user's weight. It is contemplated, however, that additional weight could be added to suit the user's physical abilities.

Further, the number of repetitions of each exercise will vary for each user and may depend on the unique fitness goals of the user.

Although knees bent and feet flat on the floor is preferred when performing all the exercises described above (except for the exercise shown in FIGS. 30–31), the user may also extend his/her legs out in front of the body.

Still further, the exercises may be performed in any sequence and any combination. The sequence of exercises and combination of exercises described above is only an example and not intended to be limiting. Only the adjustment of the device 10 and/or body position on the user support structure 14 need be changed to perform any of the multiple exercises described above at any period.

While the principles of the invention have been made clear in the illustrative embodiments set forth above, it will be apparent to those skilled in the art that various modifications may be made to the structure, arrangement, proportion, elements, materials, and components used in the practice of the invention.

It can thus be appreciated that the objectives of the present invention have been fully and effectively accomplished. The foregoing specific embodiments have been provided to illustrate the structural and functional principles of the present invention and is not intended to be limiting. To the contrary, the present invention is intended to encompass all modifications, alterations, and substitutions within the spirit and scope of the appended claims.

What is claimed is:

1. An exercise device comprising:

a pair of laterally spaced manually movable structures including U-shaped rocker elements having downwardly facing convex surfaces constructed and arranged to be supported on a horizontal surface, a user support structure connected between said pair of movable structures, said user support structure being constructed and arranged when in an operative starting position to support a user in (A) a supine position wherein the user is disposed in supine relation on the horizontal surface with the knees bent upwardly and the lower back supported on said user support structure disposed adjacent the horizontal surface and (B) a seated position wherein the user is disposed in seated relation on said user support structure disposed adjacent the horizontal surface with legs extended and bent at the knees and the feet resting on the horizontal surface, said pair of laterally spaced manually movable structures including a pair of operatively fixed hand grips disposed in an operative starting position above the horizontal surface at a level to be grasped by (A) a user in said supine position with the arms disposed upwardly and bent at the elbows and (B) a user in said seated position with the arms extending outwardly, the convex surfaces of said rocker elements of said pair of manually movable structures being configured and positioned so that a rearward operative movement of said hand grips away from the operative starting position in a rearward direction will move said user support structure upwardly from the operative starting position thereof enabling (A) a user in said supine position to (1a) effect said rearward operative movement of said hand grips in said rearward direction by extending the user's arms and (1b) resist such movement by the user's supported weight on said user support structure and (2) manually resist a return movement by the supported weight of the user on said user support structure and (B) a user in said seated position to (1a) effect said rearward operative movement of said hand grips in said rearward direction by a pull with palms down and elbows out or a curl with palms up and elbows down and (1b) resist such movement by the user's supported weight on said user support structure and (2) manually resist a return movement by the supported weight of the user on said user support structure.

2. An exercise device as defined in claim 1 wherein said U-shaped rocker elements are releasably pivotally connected with said user support structure and to said hand grips enabling said U-shaped rocker elements to be releasably pivoted into a storage position wherein said hand grips are generally aligned with said U-shaped rocker elements in adjacent relation alongside said user support structure whereas when said hand grips are in the operative starting position thereof they extend inwardly toward one another.

3. An exercise device as defined in claim 1 wherein said user support structure is constructed and arranged when in said operative starting position to support a user in the same manner as the supine position but in a reverse supine position on said user support structure wherein the user is disposed in reverse supine relation on the horizontal surface with the knees bent upwardly and the lower back supported on said user support structure disposed adjacent the horizontal surface, said hand grips being movable into a second operative starting position with respect to said U-shaped rocker elements and said user support structure, said hand grips in said second operative starting position being disposed at a level above the horizontal surface to be grasped by the user in said reverse supine position with the arms extended upwardly and outwardly enabling a user in said reverse supine position to (1a) effect said rearward operative movement of said hand grips in said rearward direction by pulling down on said hand grips and (1b) resist such movement by the user's supported weight on said user support structure and (2) manually resist a return movement by the supported weight of the user on said user support structure.

4. An exercise device as defined in claim 3 wherein said U-shaped rocker elements are releasably pivotally connected with said user support structure and to said hand grips enabling said U-shaped rocker elements to be releasably pivoted into a storage position wherein said hand grips are generally aligned with said U-shaped rocker elements in adjacent relation alongside said user support structure whereas when said hand grips are in the operative starting position and the second operative starting position thereof they extend inwardly toward one another.

5. An exercise device as defined in claim 3 wherein said hand grips in said second operative starting position being disposed at a level above the horizontal surface to be grasped by a user in said seated position with the arms disposed outwardly and bent at the elbows, the convex surfaces of the rocker elements of said pair of manually movable structures being configured and positioned so that a forward operative movement of said hand grips away from the second operative starting position in a forward direction will move said user support structure upwardly from the operative starting position thereof enabling a user in said seated position to (1a) effect said forward operative movement by extending the user's arms and (1b) resist such movement by the user's supported weight on said user support structure and (2) manually resist a return movement by the supported weight of the user on said user support structure.

6. An exercise device as defined in claim 5 wherein said U-shaped rocker elements are releasably pivotally connected with said user support structure and to said hand grips enabling said U-shaped rocker elements to be releasably pivoted into a storage position wherein said hand grips are generally aligned with said U-shaped rocker elements in adjacent relation alongside said user support structure whereas when said hand grips are in the operative starting position and the second operative starting position thereof they extend inwardly toward one another.

7. An exercise device as defined in claim 5 wherein said hand grips when in said second operative starting position include free ends facing toward one another in spaced relation and a bridging member is selectively telescopically mounted over said hand grips so as to extend in the space therebetween, said bridging member having a cushioned central portion, the configuration and position of said cushioned central portion with respect to said hand grips and the configuration of said convex surfaces enabling (A) a user in said seated position to grasp said cushioned central portion and to (1a) effect said forward operative movement by extending the arms outwardly which moves said hand grips away from the second operative starting position in said forward direction and (1b) resist such movement by the user's supported weight on the user support structure and (2) manually resist a return movement by the supported weight of the user on the user support structure, (B) a user in the seated position but with arms down to move the user's chest forwardly into the cushioned central portion of said centrally cushioned member so as to (1a) effect said forward operative movement by the continued forward movement of the chest of the user which moves said hand grips away from the second operative starting position in said forward direction and (1b) resist such movement by the user's supported weight on said user support structure and (2) resist by chest contact a return movement by the supported weight of the user on the user support structure and (C) a user seated in the same manner as in (B) but in a reverse seated position on said user support structure to move the user's back rearwardly into said cushioned central portion to (1a) effect said forward operative movement by the continued rearward movement of the user's back which moves said hand grips away from the second operative starting position in said forward direction and (1b) resist such movement by the user's supported weight on said user support structure and (2) resist by back contact a return movement by the supported weight of the user on said user support structure.

8. An exercise device as defined in claim 7 wherein said U-shaped rocker elements are releasably pivotally connected with said user support structure and to said hand grips enabling said U-shaped rocker elements to be releasably pivoted into a storage position wherein said hand grips are generally aligned with said U-shaped rocker elements in adjacent relation alongside said user support structure whereas when said hand grips are in the operative starting position and the second operative starting position thereof they extend inwardly toward one another.

9. An exercise device as defined in claim 7 wherein said U-shaped rocker elements include free ends having enlarged alternative support elements thereon constructed and arranged to cooperate with said cushioned central portion to alternatively engage the horizontal surface and support said user support structure in an elevated position over the horizontal surface enabling a user to perform leg lifts while supported by the lower abdominal region on said user support structure.

10. An exercise device as defined in claim 9 wherein each of said U-shaped rocker elements have a hand grip carrying straight arm element adjustably fixed to one end thereof.

11. An exercise device as defined in claim 10 wherein each arm element is adjustably fixed to the one end of the associated U-shaped rocker element by a releasable adjusting assembly constructed and arranged to enable each arm element to be moved between the operative starting position of said hand grips and a pair of second operative starting positions corresponding to the second operative starting position of said hand grips.

12. An exercise device as defined in claim 11 wherein each of said releasable adjusting assemblies comprises:

first and second cooperating interlocking toothed structures which are interlockable with one another to fix each arm element selectively in said operative starting position and said pair of second operative starting positions and are cooperable with one another to permit pivotal movement of each arm element with respect to said U-shaped rocker elements between said operative starting position and said pair of second operative starting positions, a releasable locking mount which is lockable to lock said first and second toothed structures in interlocking relation and is releasable to permit pivotal movement, said first toothed structure being fixed to one of said one end of said U-shaped rocker element and said arm element and said second toothed structure being fixed to the other of said one end of said U-shaped rocker element and said arm element, wherein said first and second toothed structures are biased apart from one another by a spring when said releasable locking mount is released.

13. An exercise device as defined in claim 11 wherein said pair of manually movable structures include L-shaped elements having first legs providing said hand grips and second legs mounted in said arm elements for movement between an operative position wherein the hand grip providing first legs extend toward one another and a storage position wherein the hand grip providing first legs are displaced 90° in opposite directions from said operative position.

14. An exercise device as defined in claim 13 wherein each arm element is tubular and has a longitudinal axis and each of said second legs is (1) rotatably mounted in the tubular arm element about the longitudinal axis thereof and (2) releasably fixed into said operative and storage position by a releasable locking assembly.

15. An exercise device as defined in claim 14 wherein each releasable locking assembly comprises:

a releasing knob including an elongated pin secured thereto;

an arm element securing member fixedly secured within an opening in said arm element and coupled to said releasing knob to enable axial movement of said releasing knob with respect to said arm element securing member between locking and releasing positions, a spring operatively connected between said releasing knob and said arm element securing member constructed and arranged to bias said releasing knob into said locking position wherein said pin extends into one of a plurality of openings in said second leg, said releasing knob being constructed and arranged to be manually moved against the biasing of the spring thereof to move the same into said releasing position thereof wherein said pin is moved out of said opening in said second leg.

16. An exercise device as defined in claim 13 wherein said user support structure comprises a tubular member having a transversely extending axis, a central portion and opposite end portions, a cushion assembly mounted on the central portion of said tubular member for rotational movement about the axis thereof, and a releasably lockable pivotal connection between each end portion and a central portion of an adjacent U-shaped rocker element, each releasably lockable pivotal connection constructed and arranged to enable each U-shaped rocker element to be (1) fixedly locked in an operative position wherein said U-shaped rocker elements extend in spaced parallel relation with respect to one another with said tubular element extending generally perpendicularly therebetween, said arm elements forming extensions of said U-shaped elements and said hand grips extending inwardly with respect to said arm elements and perpendicularly with respect to said U-shaped elements in oppositely facing relation with respect to one another and in generally parallel relation to said tubular member, and (2) releasably pivoted into the storage position wherein said arm elements and said hand grips are generally aligned with said U-shaped rocker elements in adjacent relation alongside said cushion assembly.

17. An exercise device as defined in claim 16 wherein each releasably lockable pivotal connection comprises:

a mounting portion including a pair of parallel arm members fixed to the central portion of an associated U-shaped rocker element, each pair of arm members being spaced so as to receive an adjacent end portion of said tubular member in pivotally mounted relation therebetween to allow relative pivotal movement between the associated rocker element and the adjacent end portion of the tubular member between operative and storage positions, a locking member movable between locking and releasing positions and having a threaded shaft secured thereto which extends through an opening in said mounting portion and into a threaded opening of the adjacent end portion of said tubular member when said locking member is in the locking position thereof to releasably lock the associated rocker element in the operative position thereof, said threaded shaft being removed from the threaded opening of the adjacent end portion and the opening in the mounting portion when said locking member is in the releasing position thereof enabling the associated rocker element to be pivoted to the storage position.

18. An exercise device as defined in claim 7 wherein each of said U-shaped rocker elements have a hand grip carrying straight arm element adjustably fixed to one end thereof, each arm element is adjustably fixed to the one end of the associated U-shaped rocker element by a releasable adjusting assembly constructed and arranged to enable each arm element to be moved between the operative starting position of said hand grips and a pair of second operative starting positions corresponding to the second operative starting position of said hand grips.

19. An exercise device as defined in claim 18 wherein said pair of manually movable structures include L-shaped elements having first legs providing said hand grips and second legs mounted in said arm elements for movement between an operative position wherein the hand grip providing first legs extend toward one another and a storage position wherein the hand grip providing first legs are displaced 90° in opposite directions from said operation position.

20. An exercise device as defined in claim 19 wherein said user support structure comprises a tubular member having a transversely extending axis, a central portion and opposite end portions, a cushion assembly mounted on the central portion of said tubular member for rotational movement about the axis thereof, and a releasably lockable pivotal connection between each end portion and a central portion of an adjacent U-shaped rocker element each releasably lockable pivotal connection constructed and arranged to enable each U-shaped rocker element to be (1) fixedly locked in an operative position wherein said U-shaped rocker elements extend in spaced parallel relation with respect to one another with said tubular element extending generally perpendicularly therebetween, said arm elements forming extensions of said U-shaped elements and said hand grips extending inwardly with respect to said arm elements and perpendicularly with respect to said U-shaped elements in oppositely facing relation with respect to one another and in generally parallel relation to said tubular element, and (2) releasably pivoted into the storage position wherein said arm elements and said hand grips are generally aligned with said U-shaped rocker elements in adjacent relation alongside said cushion assembly.

21. An exercise device as defined in claim 5 wherein each of said U-shaped rocker elements have a hand grip carrying straight arm element adjustably fixed to one end thereof, said pair of manually movable structures include L-shaped elements having first legs providing said hand grips and second legs mounted in said arm elements for movement between an operative position wherein the hand grip providing first legs extend toward one another and a storage position wherein the hand grip providing first legs are displaced 90° in opposite directions from said operation position, said user support structure comprises a tubular member having a transversely extending axis, a central portion and opposite end portions, a cushion assembly mounted on the central portion of said tubular member for rotational movement about the axis thereof, and a releasably lockable pivotal connection between each end portion and a central portion of an adjacent U-shaped rocker element each releasably lockable pivotal connection constructed and arranged to enable each U-shaped rocker element to be (1) fixedly locked in an operative position wherein said U-shaped rocker elements extend in spaced parallel relation with respect to one another with said tubular element extending generally perpendicularly therebetween, said arm elements forming extensions of said U-shaped elements and said hand grips extending inwardly with respect to said arm elements and perpendicularly with respect to said U-shaped elements in oppositely facing relation with respect to one another and in generally parallel relation to said tubular element, and (2) releasably pivoted into the storage position wherein said arm elements and said hand grips are generally aligned with said U-shaped rocker elements in adjacent relation alongside said cushion assembly.

22. An exercise device as defined in claim 3 wherein each of said U-shaped rocker elements have a hand grip carrying straight arm element adjustably fixed to one end thereof, said pair of manually movable structures include L-shaped elements having first legs providing said hand grips and second legs mounted in said arm elements for movement between an operative position wherein the hand grip providing first legs extend toward one another and a storage position wherein the hand grip providing first legs are displaced 90° in opposite directions from said operation position, said user support structure comprises a tubular member having a transversely extending axis, a central portion and opposite end portions, a cushion assembly mounted on the central portion of said tubular member for rotational movement about the axis thereof, and a releasably lockable pivotal connection between each end portion and a central portion of an adjacent U-shaped rocker element each releasably lockable pivotal connection constructed and arranged to enable each U-shaped rocker element to be (1) fixedly locked in an operative position wherein said U-shaped rocker elements extend in spaced parallel relation with respect to one another with said tubular element extending generally perpendicularly therebetween, said arm elements forming extensions of said U-shaped elements and said hand grips extending inwardly with respect to said arm elements and perpendicularly with respect to said U-shaped elements in oppositely facing relation with respect to one another and in generally parallel relation to said tubular element, and (2) releasably pivoted into the storage position wherein said arm elements and said hand grips are generally aligned with said U-shaped rocker elements in adjacent relation alongside said cushion assembly.

23. An exercise device as defined in claim 1 wherein said hand grips are movable into a second operative starting position with respect to said U-shaped rocker elements and said user support structure, said hand grips in said second operative starting position being disposed at a level above the horizontal surface to be grasped by a user in said seated position with the arms disposed outwardly and bent at the elbows, the convex surfaces of the rocker elements of said pair of manually movable structures being configured and positioned so that a forward operative movement of said hand grips away from the second operative starting position in a forward direction will move said user support structure upwardly from the operative starting position thereof enabling a user in said seated starting position to (1a) effect said forward operative movement by extending the user's arms and (1b) resist such movement by the user's supported weight on said user support structure and (2) manually resist a return movement by the supported weight of the user on said user support structure.

24. An exercise device as defined in claim 23 wherein said U-shaped rocker elements are releasably pivotally connected with said user support structure and to said hand grips enabling said U-shaped rocker elements to be releasably pivoted into a storage position wherein said hand grips are generally aligned with said U-shaped rocker elements in adjacent relation alongside said user support structure whereas when said hand grips are in the operative starting position and the second operative starting position thereof they extend inwardly toward one another.

25. An exercise device as defined in claim 23 wherein said hand grips when in said second operative starting position include free ends facing toward one another in spaced relation and a bridging member is selectively telescopically mounted over said hand grips so as to extend in the space therebetween, said bridging member having a cushioned central portion, the configuration and position of said cushioned central portion with respect to said hand grips and the configuration of said convex surfaces enabling (A) a user in said seated position to grasp said cushioned central portion and to (1a) effect said forward operative movement by extending the arms outwardly which moves said hand grips away from the second operative starting position in said forward direction and (1b) resist such movement by the user's supported weight on the user support structure and (2) manually resist a return movement by the supported weight of the user on the user support structure, (B) a user in the seated position but with arms down to move the user's chest forwardly into the cushioned central portion of said centrally cushioned member so as to (1a) effect said forward operative movement by the continued forward movement of the chest of the user which moves said hand grips away from the second operative starting position in said forward direction and (1b) resist such movement by the user's supported weight on said user support structure and (2) resist by chest contact a return movement by the supported weight of the user on the user support structure and (C) a user seated in the same manner as in (B) but in a reverse seated position on said user support structure to move the user's back rearwardly into said cushioned central portion to (1a) effect said forward operative movement by the continued rearward movement of the user's back which moves said hand grips away from the second operative starting position in said forward direction and (1b) resist such movement by the user's supported weight on said user support structure and (2) resist by back contact a return movement by the supported weight of the user on said user support structure.

26. An exercise device as defined in claim 25 wherein said U-shaped rocker elements are releasably pivotally connected with said user support structure and to said hand grips enabling said U-shaped rocker elements to be releasably pivoted into a storage position wherein said hand grips are generally aligned with said U-shaped rocker elements in adjacent relation alongside said user support structure whereas when said hand grips are in the operative starting position the second operative starting position thereof they extend inwardly toward one another.

27. An exercise device as defined in claim 1 wherein said hand grips are movable into a second operative starting position with respect to said U-shaped rocker elements and said user support structure, said hand grips when in said second operative starting position include free ends facing toward one another in spaced relation and a bridging member is selectively telescopically mounted over said hand grips so as to extend in the space therebetween, said bridging member having a cushioned central portion, the configuration and position of said cushioned central portion with respect to said hand grips enabling (A) a user in said seated position to grasp said cushioned central portion with the arms disposed outwardly and bent at the elbows and (B) a user in the seated position but with the arms down to move the user's chest forwardly into the cushioned central portion of said centrally cushioned member and (C) a user in a reverse seated position wherein the user is disposed in the same manner as the seated position but in a reverse position on said user support structure to move the user's back rearwardly into said cushioned central portion, the convex surfaces of the rocker elements of said pair of manually movable structures being configured and positioned so that a forward operative movement of said hand grips away from the second operative starting position in a forward direction will move said user support structure upwardly from the operative starting position thereof enabling (A) a user in said seated position to grasp said cushioned central portion and to (1a) effect said forward operative movement by extending the arms outwardly which moves said hand grips away from the second operative starting position in said forward direction and (1b) resist such movement by the user's supported weight on the user support structure and (2) manually resist a return movement by the supported weight of the user on the user support structure, (B) a user in the seated position but with arms down to move the user's chest forwardly into the cushioned central portion of said centrally cushioned member so as to (1a) effect said forward operative movement by the continued forward movement of the chest of the user which moves said hand grips away from the second operative starting position in said forward direction and (1b) resist such movement by the user's supported weight on said user support structure and (2) resist by chest contact a return movement by the supported weight of the user on the user support structure and (C) a user seated in the same manner as in (B) but in a reverse seated position on said user support structure to move the user's back rearwardly into said cushioned central portion to (1a) effect said forward operative movement by the continued rearward movement of the user's back which moves said hand grips away from the second operative starting position in said forward direction and (1b) resist such movement by the user's supported weight on said user support structure and (2) resist by back contact a return movement by the supported weight of the user on said user support structure.

28. An exercise device as defined in claim 27 wherein said U-shaped rocker elements are releasably pivotally connected with said user support structure and to said hand grips enabling said U-shaped rocker elements to be releasably pivoted into a storage position wherein said hand grips are generally aligned with said U-shaped rocker elements in adjacent relation alongside said user support structure whereas when said hand grips are in the operative starting position and the second operative starting position thereof they extend inwardly toward one another.

29. An exercise device comprising:

a pair of laterally spaced manually movable structures including U-shaped rocker elements having downwardly facing convex surfaces constructed and arranged to be supported on a horizontal surface, a user support structure connected between said pair of movable structures, said user support structure being constructed and arranged when in an operative starting position to support a user in a seated position wherein the user is disposed in seated relation on said user support structure disposed adjacent the horizontal surface with legs extended and bent at the knees and the feet resting on the horizontal surface, said pair of laterally spaced manually movable structures including a pair of operatively fixed hand grips disposed in an operative starting position above the horizontal surface at a level to be grasped by a user in said seated position with the arms disposed outwardly and bent at the elbows, the convex surfaces of said rocker elements of said pair of manually movable structures being configured and positioned so that a forward operative movement of said hand grips away from the operative starting position in a forward direction will move said user support structure upwardly from the operative starting position thereof enabling a user in said seated starting position to (1a) effect said forward operative movement by extending the user's arms and (1b) resist such movement by the user's supported weight on said user support structure and (2) manually resist a return movement by the supported weight of the user on said user support structure.

30. An exercise device as defined in claim 29 wherein said user support structure is constructed and arranged when in said operative starting position to support a user in a supine position wherein the user is disposed in supine relation on the horizontal surface with the knees bent upwardly and the lower back supported on said user support structure disposed adjacent the horizontal surface, said hand grips in said operative starting position being disposed at a level above the horizontal surface to be grasped by the user in said supine position with the arms extended upwardly and outwardly, the convex surfaces of the rocker elements of said pair of manually movable structures being configured and positioned so that a rearward operative movement of said hand grips away from the operative starting position in a rearward direction will move said user support structure upwardly from the operative starting position thereof enabling a user in said supine position to (1a) effect said rearward operative movement of said hand grips in said rearward direction by pulling down on said hand grips and (1b) resist such movement by the user's supported weight on said user support structure and (2) manually resist a return movement by the supported weight of the user on said user support structure.

31. An exercise device as defined in claim 30 wherein said hand grips when in said operative starting position include free ends facing toward one another in spaced relation and a bridging member is selectively telescopically mounted over said hand grips so as to extend in the space therebetween, said bridging member having a cushioned central portion, the configuration and position of said cushioned central portion with respect to said hand grips and the configuration of said convex surfaces enabling (A) a user in said seated position to grasp said cushioned central portion and to (1a) effect said forward operative movement by extending the arms outwardly which moves said hand grips away from the operative starting position in said forward direction and (1b) resist such movement by the user's supported weight on the user support structure and (2) manually resist a return movement by the supported weight of the user on the user support structure, (B) a user in the seated position but with arms down to move the user's chest forwardly into the cushioned central portion of said centrally cushioned member so as to (1a) effect said forward operative movement by the continued forward movement of the chest of the user which moves said hand grips away from the operative starting position in said forward direction and (1b) resist such movement by the user's supported weight on said user support structure and (2) resist by chest contact a return movement by the supported weight of the user on the user support structure and (C) a user seated in the same manner as in (B) but in a reverse seated position on said user support structure to move the user's back rearwardly into said cushioned central portion to (1a) effect said forward operative movement by the continued rearward movement of the user's back which moves said hand grips away from the operative starting position in said forward direction and (1b) resist such movement by the user's supported weight on said user support structure and (2) resist by back contact a return movement by the supported weight of the user on said user support structure.

32. An exercise device comprising:

a pair of laterally spaced manually movable structures including U-shaped rocker elements having downwardly facing convex surfaces constructed and arranged to be supported on a horizontal surface, a user support structure connected between said pair of movable structures, said user support structure being constructed and arranged when in an operative starting position to support a user in a supine position wherein the user is disposed in supine relation on the horizontal surface with the knees bent upwardly and the lower back supported on said user support structure disposed adjacent the horizontal surface, said pair of laterally spaced manually movable structures including a pair of operatively fixed hand grips disposed in an operative starting position above the horizontal surface at a level to be grasped by a user in said supine position with the arms extended upwardly and outwardly, the convex surfaces of said rocker elements of said pair of manually movable structures being configured and positioned so that a rearward operative movement of said hand grips away from the operative starting position in a rearward direction will move said user support structure upwardly from the operative starting position thereof enabling a user in said supine position to (1a) effect said rearward operative movement of said hand grips in said rearward direction by pulling down on said hand grips and (1b) resist such movement by the user's supported weight on said user support structure and (2) manually resist a return movement by the supported weight of the user on said user support structure.

33. An exercise device as defined in claim 32 wherein said user support structure is constructed and arranged when in an operative starting position to support a user in (A) a seated position wherein the user is disposed in seated relation on said user support structure disposed adjacent the horizontal surface with legs extended and bent at the knees and the feet resting on the horizontal surface and (B) a reverse seated position wherein the user is disposed in the same manner as in (A) but in a reverse position on said user support structure, said hand grips when in said operative starting position include free ends facing toward one another in spaced relation and a bridging member is selectively telescopically mounted over said hand grips so as to extend in the space therebetween, said bridging member having a cushioned central portion, the configuration and position of said cushioned central portion with respect to said hand grips enabling (A) a user in said seated position to grasp said cushioned central portion with the arms disposed outwardly and bent at the elbows and (B) a user in the seated position but with the arms down to move the user's chest forwardly into the cushioned central portion of said centrally cushioned member and (C) a user in the reverse seated position on said user support structure to move the user's back rearwardly into said cushioned central portion, the convex surfaces of the rocker elements of said pair of manually movable structures being configured and positioned so that a forward operative movement of said hand grips away from the operative starting position in a forward direction will move said user support structure upwardly from the operative starting position thereof enabling (A) a user in said seated position to grasp said cushioned central portion and to (1a) effect said forward operative movement by extending the arms outwardly which moves said hand grips away from the operative starting position in said forward direction and (1b) resist such movement by the user's supported weight on the user support structure and (2) manually resist a return movement by the supported weight of the user on the user support structure, (B) a user in the seated position but with arms down to move the user's chest forwardly into the cushioned central portion of said centrally cushioned member so as to (1a) effect said forward operative movement by the continued forward movement of the chest of the user which moves said hand grips away from the operative starting position in said forward direction and (1b) resist such movement by the user's supported weight on said user support structure and (2) resist by chest contact a return movement by the supported weight of the user on the user support structure and (C) a user seated in the same manner as in (B) but in a reverse seated position on said user support structure to move the user's back rearwardly into said cushioned central portion to (1a) effect said forward operative movement by the continued rearward movement of the user's back which moves said hand grips away from the operative starting position in said forward direction and (1b) resist such movement by the user's supported weight on said user support structure and (2) resist by back contact a return movement by the supported weight of the user on said user support structure.

34. An exercise device comprising:

a pair of laterally spaced manually movable structures including U-shaped rocker elements having downwardly facing convex surfaces constructed and arranged to be supported on a horizontal surface, a user support structure connected between said pair of movable structures, said user support structure being constructed and arranged when in an operative starting position to support a user in (A) a seated position wherein the user is disposed in seated relation on said user support structure disposed adjacent the horizontal surface with legs extended and bent at the knees and the feet resting on the horizontal surface and (B) a reverse seated position wherein the user is disposed in the same manner as in (A) but in a reverse position on said user support structure, said pair of laterally spaced manually movable structures including a pair of operatively fixed hand grips disposed in an operative starting position above the horizontal surface, said hand grips when in said operative starting position including free ends facing toward one another in spaced relation and a bridging member is selectively telescopically mounted over said hand grips so as to extend in the space therebetween, said bridging member having a cushioned central portion, the configuration and position of said cushioned central portion with respect to said hand grips enabling (A) a user in said seated position to grasp said cushioned central portion with the arms disposed outwardly and bent at the elbows and (B) a user in the seated'position but with the arms down to move the user's chest forwardly into the cushioned central portion of said centrally cushioned member and (C) a user in the reverse seated position on said user support structure to move the user's back rearwardly into said cushioned central portion, the convex surfaces of said rocker elements of said pair of manually movable structures being configured and positioned so that a forward operative movement of said hand grips away from the operative starting position in a forward direction will move said user support structure upwardly from the operative starting position thereof enabling (A) a user in said seated position grasping said cushioned central portion to (1a) effect said forward operative movement by extending the arms outwardly which moves said hand grips away from the operative starting position in said forward direction and (1b) resist such movement by the user's supported weight on the user support structure and (2) manually resist a return movement by the supported weight of the user on the user support structure, (B) a user in the seated position but with arms down and the user's chest moved forwardly into the cushioned central portion of said centrally cushioned member to (1a) effect said forward operative movement by the continued forward movement of the chest of the user which moves said hand grips away from the operative starting position in said forward direction and (1b) resist such movement by the user's supported weight on said user support structure and (2) resist by chest contact a return movement by the supported weight of the user on the user support structure and (C) a user seated in the reverse seated position on said user support structure and the user's back moved rearwardly into said cushioned central portion to (1a) effect said forward operative movement by the continued rearward movement of the user's back which moves said hand grips away from the operative starting position in said forward direction and (1b) resist such movement by the user's supported weight on said user support structure and (2) resist by back contact a return movement by the supported weight of the user on said user support structure.

* * * * *

UNITED STATES PATENT AND TRADEMARK OFFICE

CERTIFICATE OF CORRECTION

PATENT NO. : 6,592,500 B1
DATED : July 15, 2003
INVENTOR(S) : McBride et al.

It is certified that error appears in the above-identified patent and that said Letters Patent is hereby corrected as shown below:

Drawings,

FIG. 10, reference numeral "106a" on the left side of the figure should be -- 106b --. Also, in FIG. 10, the extra line above "36a" should be removed. Please see corrected FIG. 10 below that incorporates the corrections discussed above.

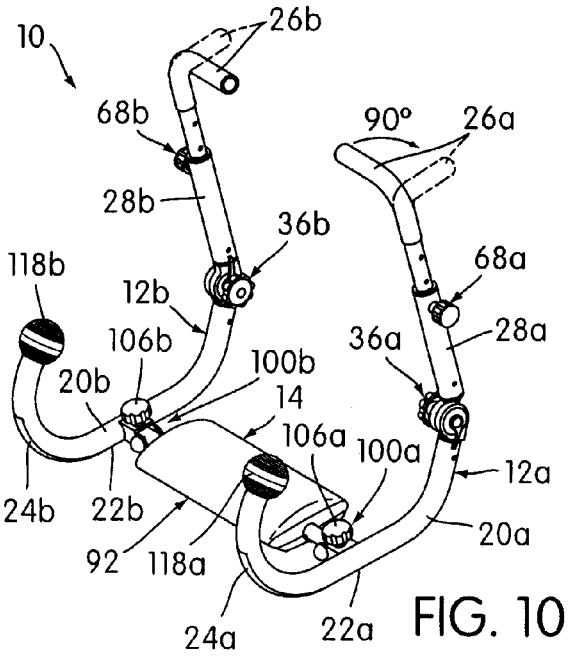

FIG. 10

Signed and Sealed this

Twentieth Day of July, 2004

JON W. DUDAS
*Acting Director of the United States Patent and Trademark Office*